US007722431B2

(12) United States Patent
Sullivan et al.

(10) Patent No.: US 7,722,431 B2
(45) Date of Patent: May 25, 2010

(54) CUSTOMIZABLE WOBBLE OBJECTS

(75) Inventors: John C. Sullivan, Madison, CT (US); Jeffrey Stanley Samson, Irvine, CA (US)

(73) Assignee: Action Wobble, Inc., Irvine, CA (US)

( * ) Notice: Subject to any disclaimer, the term of this patent is extended or adjusted under 35 U.S.C. 154(b) by 1075 days.

(21) Appl. No.: 10/825,496

(22) Filed: Apr. 15, 2004

(65) Prior Publication Data

US 2005/0001113 A1 Jan. 6, 2005

Related U.S. Application Data

(60) Provisional application No. 60/462,931, filed on Apr. 15, 2003.

(51) Int. Cl.
*A63H 33/26* (2006.01)
*A63H 33/00* (2006.01)

(52) U.S. Cl. ..... 446/486; 446/391; 40/411

(58) Field of Classification Search ..... 446/321, 446/486, 365, 139, 100, 391; 40/411, 764; 248/450, 451, 453
See application file for complete search history.

(56) References Cited

U.S. PATENT DOCUMENTS

| | | | | |
|---|---|---|---|---|
| 1,561,829 | A | 11/1925 | Cohn | |
| 1,822,437 | A | 9/1931 | Fleming | |
| 2,243,912 | A | 6/1941 | Legler | |
| 2,484,343 | A * | 10/1949 | Hawes | 446/177 |
| 2,554,516 | A * | 5/1951 | Anthony | 446/325 |
| 2,760,303 | A * | 8/1956 | Del Mas | 446/97 |
| 3,195,256 | A * | 7/1965 | Core | 40/744 |
| 3,272,183 | A * | 9/1966 | Craighead et al. | 248/453 |
| 4,356,658 | A | 11/1982 | Goldfarb | |
| 4,662,630 | A * | 5/1987 | Dignard et al. | 482/83 |
| 5,280,905 | A * | 1/1994 | Micco | 473/444 |
| 5,676,374 | A | 10/1997 | Bossa et al. | |
| 5,901,721 | A * | 5/1999 | Sadeghvaziri | 135/16 |
| D413,152 | S * | 8/1999 | Chow | D21/635 |
| 6,129,606 | A * | 10/2000 | Yuen | 446/325 |
| 6,230,425 | B1 * | 5/2001 | Ellison | 40/124.01 |
| 6,394,874 | B1 * | 5/2002 | Kubo et al. | 446/327 |

(Continued)

FOREIGN PATENT DOCUMENTS

| | | |
|---|---|---|
| FR | 1019607 | 1/1953 |
| JP | 55-118772 U | 8/1980 |

OTHER PUBLICATIONS

International Search Report and Written Opinion dated Nov. 7, 2006 from corresponding PCT Application Serial No. PCT/US04/11583.

(Continued)

*Primary Examiner*—Kien T Nguyen
(74) *Attorney, Agent, or Firm*—Pearne & Gordon LLP

(57) ABSTRACT

An action wobble head doll includes a preprinted, die cut, animated body having an image secured thereto. The image can be a customized digital photograph. The image is secured to the body of the doll via a mounting assembly, which includes a spring secured to at least one mounting plate in a substantially perpendicular manner thereby creating a unique side-to-side movement of the image with respect to the body.

28 Claims, 25 Drawing Sheets

U.S. PATENT DOCUMENTS 6,511,359 B1 1/2003 Lui
6,533,634 B1 * 3/2003 Sugar ..... 446/72
6,729,930 B1 * 5/2004 Lui ..... 446/139
2002/0166513 A1 11/2002 Van Sluis
2003/0145501 A1 8/2003 Yarnall

OTHER PUBLICATIONS

Supplementary European Search Report dated Aug. 20, 2008 from corresponding European Application Serial No. 04759544.

* cited by examiner

CUSTOMIZABLE WOBBLE OBJECTS

This application claims the benefit of U.S. Provisional Patent Application Ser. No. 60/462,931 filed Apr. 15, 2003.

FIELD OF THE INVENTION

The present invention relates to toy figurines and more particularly, to customizable wobble heads.

BACKGROUND OF THE INVENTION

Bobblehead dolls are popular toy figurines, which feature a mounted head that allows movement. It is common for the head to be connected with a spring, which allows random movement in limited directions. This movement is frequently termed as bobbing or bobbling.

The bobblehead dolls are typically small ceramic, resin, or plastic cast stationary bodies with spring mounted distinctive heads featuring the likenesses of a variety of stars (e.g., sports, movie, rock, historic persons). The motion in the toy figurines is supplied by a vertically mounted spring, most often attached in or as a neck under a hollow bobbling head. Recent updates to the bobblehead dolls include a plastic portrait window mounted in place of the face.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a mounting assembly for an image is provided. The mounting assembly includes a first mounting plate and a spring secured to the first mounting plate. The spring is positioned substantially perpendicular with respect to the first mounting plate. An image, which can be customized, is secured to the first mounting plate.

In accordance with another aspect of the present invention, a mounting assembly for an image is provided. The mounting assembly includes a cam provided within a cam housing, wherein a portion of the cam projects from a first side of the cam housing; a mounting plate coupled to the portion of the cam that projects from the cam housing; and an image secured to a second side of the cam housing.

In accordance with yet another aspect of the present invention, a wobble head doll is provided, which includes a body; and at least one image coupled to the body via at least one spring extending substantially perpendicular between a vertical plane of the body and a vertical plane of the image, such that the image can be activated manually by a light touch and inertia takes over darting the head/image from side to side in a wobble/wiggle type motion.

In accordance with yet another aspect of the present invention, a kit for creating wobble objects is provided. The kit includes paper for printing a desired image; and a mounting assembly to secure to a back side of the image, wherein the mounting assembly includes at least one mounting plate and at least one spring secured to the mounting plate in a substantially perpendicular manner.

The following description and the annexed drawings set forth in detail certain illustrative aspects of the invention.

These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

DETAILED DESCRIPTION OF THE INVENTION

Figure 1:
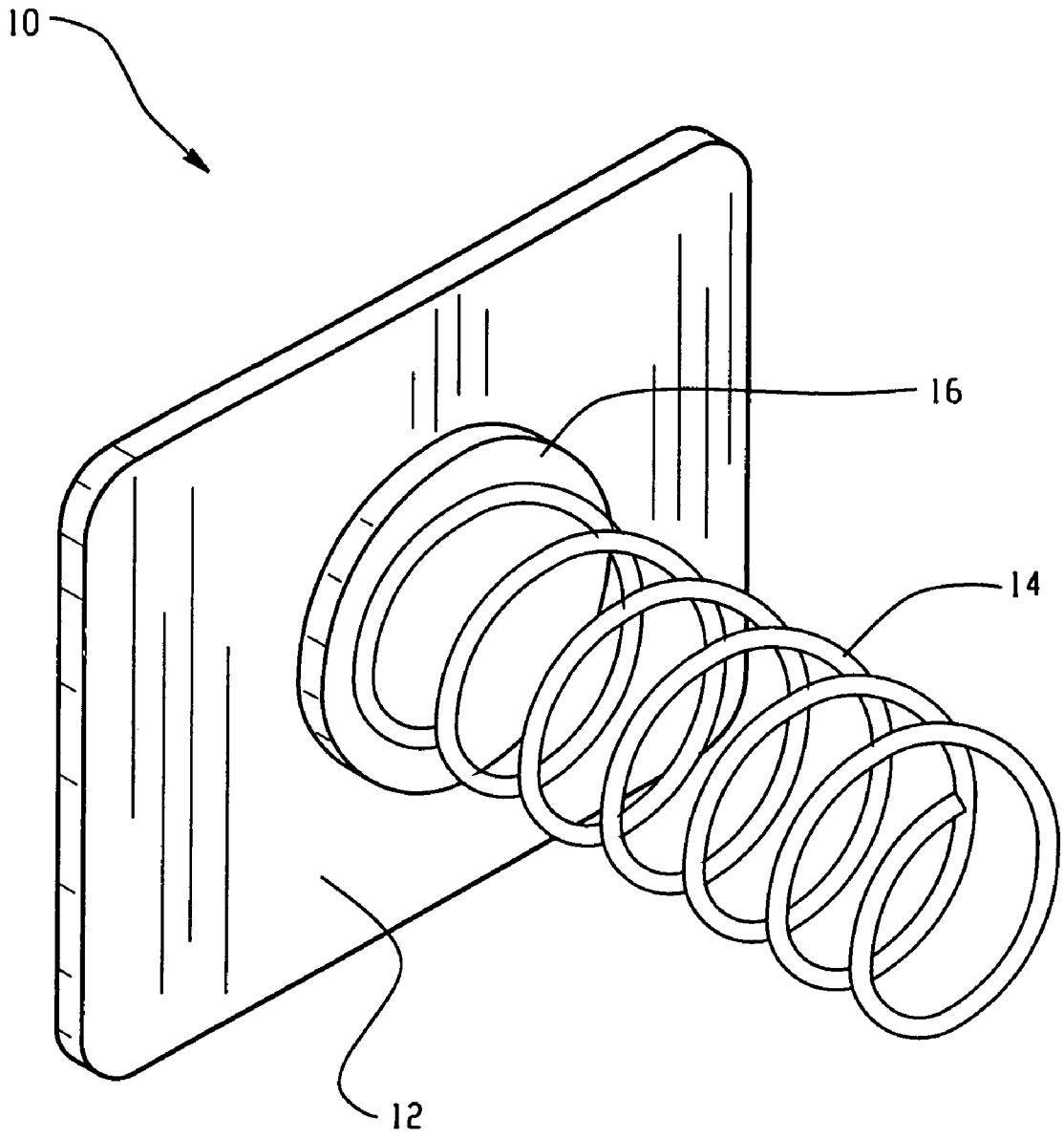
FIG. 1 illustrates a perspective view of a mounting assembly for a wobble head in accordance with an aspect of the present invention.

The present invention relates to custom wobble heads and kits for assembling custom wobble heads. The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details. In other instances, well-known structures and devices are shown in block form in order to facilitate describing the present invention.

Figure 2:
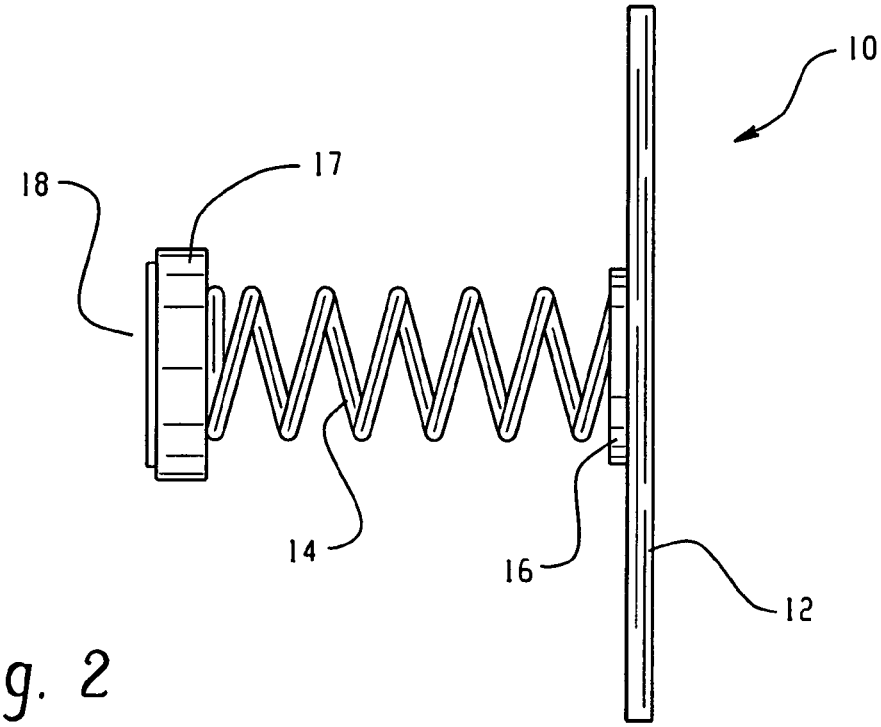
FIG. 2 illustrates a side view of the mounting assembly of FIG. 1 in accordance with an aspect of the present invention.

Referring initially to FIG. 1, an example of a mounting assembly 10 for a wobble head is illustrated in accordance with an aspect of the present invention. The mounting assembly 10 includes a first mounting plate 12 and a spring 14. A first end portion of the spring 14 is coupled to the first mounting plate 12 via at least one spring seat 16. The first mounting plate 12 can be a thin paper, plastic, cardboard, or other plate-like structure, having a first and second side. The first side is adapted to secure to a photo (not shown) via an adhesive. The adhesive can be pre-applied to the first side of the first mounting plate 12 and can include a film provided thereon, which is removed prior to use. However, it is to be appreciated that the photo can be secured to the first mounting plate 12 via a magnet, fastener (e.g., a hook and loop fastener), suction cup, or any other suitable structure and/or method. The first end of the spring 14 is coupled to the second side of the first mounting plate 12 at a substantially perpendicular angle, as depicted in FIG. 2. The spring seat 16, which can be an epoxy resin, for example, is utilized to sufficiently secure the spring 14 to the first mounting plate 12 so that movement of the first mounting plate 12 will not disengage the first mounting plate 12 with the spring 14.

Optionally, the mounting assembly 10 can include a microchip 17. The microchip 17 can coupled to the spring 14, and preferably, secured to a second end portion of the spring 14 via a spring seat. An adhesive 18, or the like, is utilized to secure the microchip 17 to any desirable surface. The microchip 17 is operable to provide voice activation and audio for an image secured to the mounting assembly 10. Thus, a wobble assembly can include an audio output such as a prerecorded or recordable greeting, an animal sound (e.g., dog barks, cat meows), a car horn beeping, music, etc. and/or a battery, microchip, or solar power to provide movement.

Figure 3:
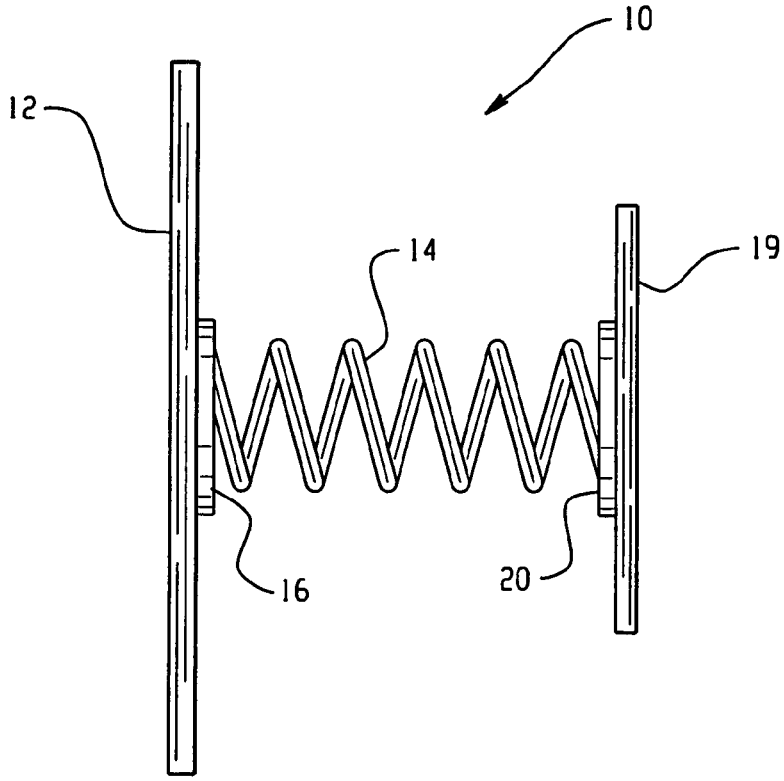
FIG. 3 illustrates a side view of the mounting assembly of FIG. 1 in accordance with another aspect of the present invention.

Turning now to FIG. 3, the mounting assembly 10 can include a second mounting plate 19 coupled to the second end portion of the spring 14 via a second spring seat 20. Alternatively, if the microchip 17 is utilized, the second mounting plate 19 can be coupled to the microchip 17. Like the first mounting plate 12, the second mounting plate 19 can include an adhesive, fastener, or the like, such that the second mounting plate 19 can be utilized to couple the mounting assembly 10 to a background.

Figure 4:
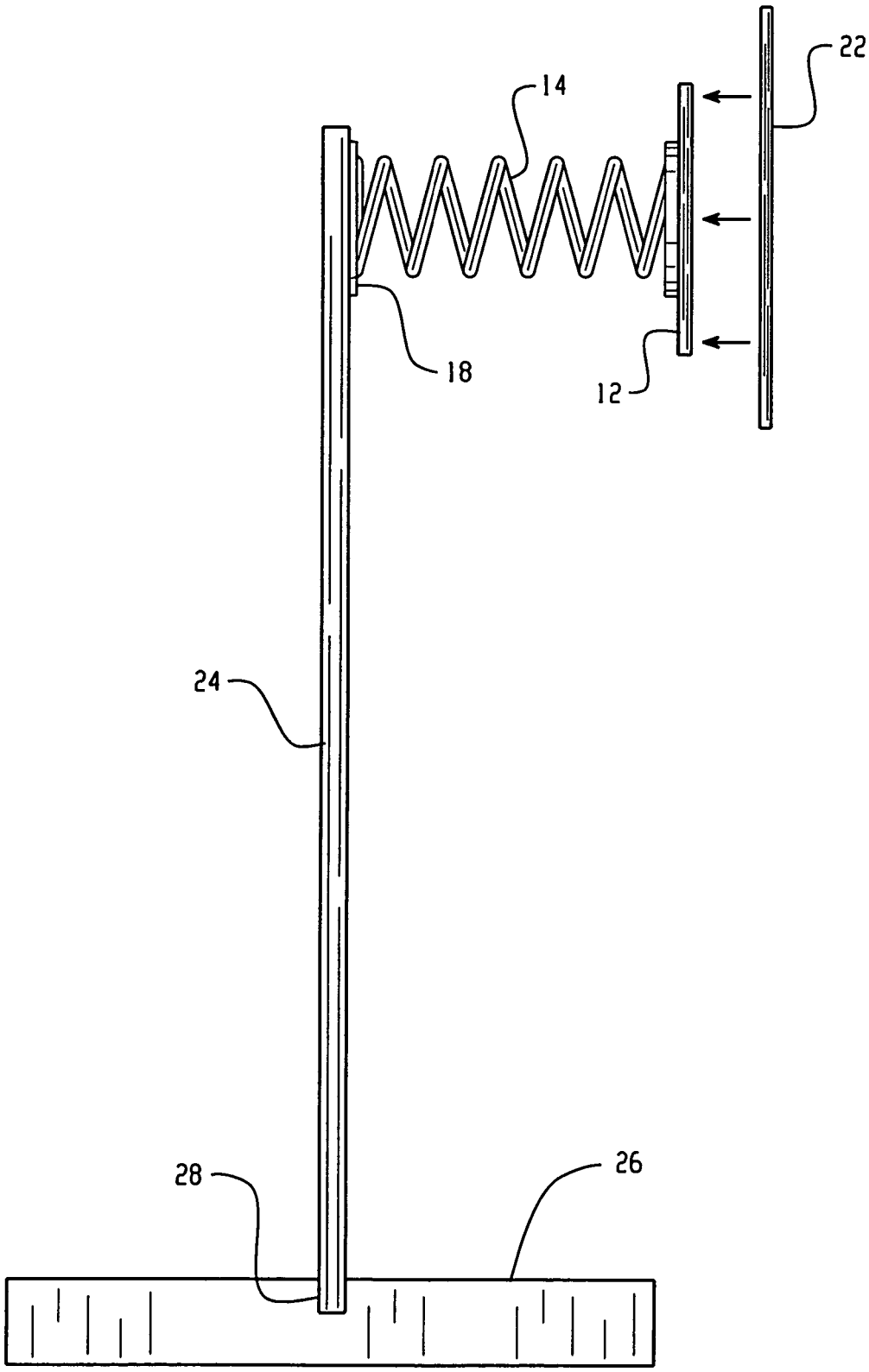
FIG. 4 illustrates a side view of a wobble head doll in accordance with an aspect of the present invention.
Figure 5:
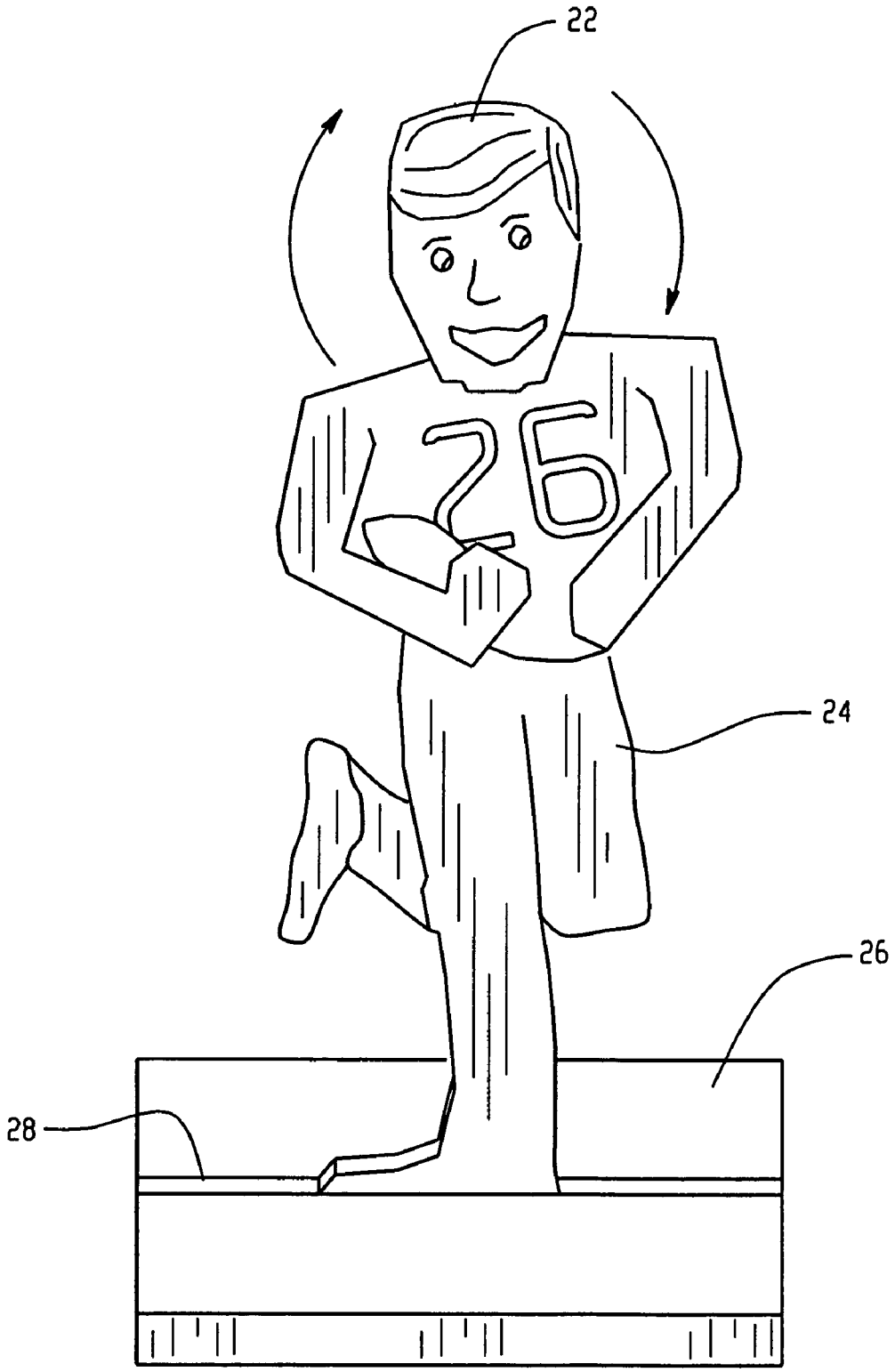
FIG. 5 illustrates a front view of a wobble head doll in accordance with an aspect of the present invention.

For example, the mounting assembly 10 can be employed to mount a photograph of a head 22 onto a body 24, as shown in FIGS. 4 and 5. The head 22 can be constructed from a high-resolution digital photograph on thick, gloss photo paper or any other suitable media. The head 22 can be of a specific person (e.g., oneself, family member, friend, celebrity) or a pet (e.g., dog, cat). The body 24 can be constructed from pressboard, plastic, metal, wood, or the like, and includes a full color printed image, for example, an athlete (e.g., tennis player, ice skater, skateboarder, cyclist, basketball player), a media personality, an actor/actress, singer, or even an inanimate object, such as a sports car, a motor boat, etc. A base 26 having a slot 28 formed therein can be employed to support the body 24. The base 26 can be manufactured from plastic, wood, metal, or any other suitable material.

When mounted to the body 24, the head 22 is able to wobble with respect to the body via the spring 14. The wobble movement of the head 22 depends upon a length, material, and wire diameter of the spring 14. For example, the spring 14 can be a compression spring with flat ends and music wire plated with a free length of 0.625 in., an outside diameter of 0.0180 in., an inside diameter of 0.188 in., a wire diameter of 0.012 in., a load of 0.69 lbs, a spring rate of 1.3 lbs, and a solid compressed height of 0.099 in. Moreover, because the head 22 is mounted substantially perpendicularly with respect to the body 24, the head 22 wobbles in a unique side to side motion that can last up to thirty seconds or longer when set in motion. The wobble action of the head 22 is a clockwise and counterclockwise movement of the head 22 with the spring 14 acting as a pivot point. It is to be appreciated that any item can be animated with the wobble motion. For example, a hand can be attached to the body via the mounting assembly 10 to provide a waving motion. Other examples of items that can be attached via the mounting assembly 10 include a rotating ball, a food item (e.g., cup of coffee/tea, can of soda/beer, a donut, ice cream, cookie, hot dog, burger), a book, flowers, a gift, or a branded product, such as a COKE®, a SNICKERS®, etc. can be attached for advertising purposes.

Figure 6:
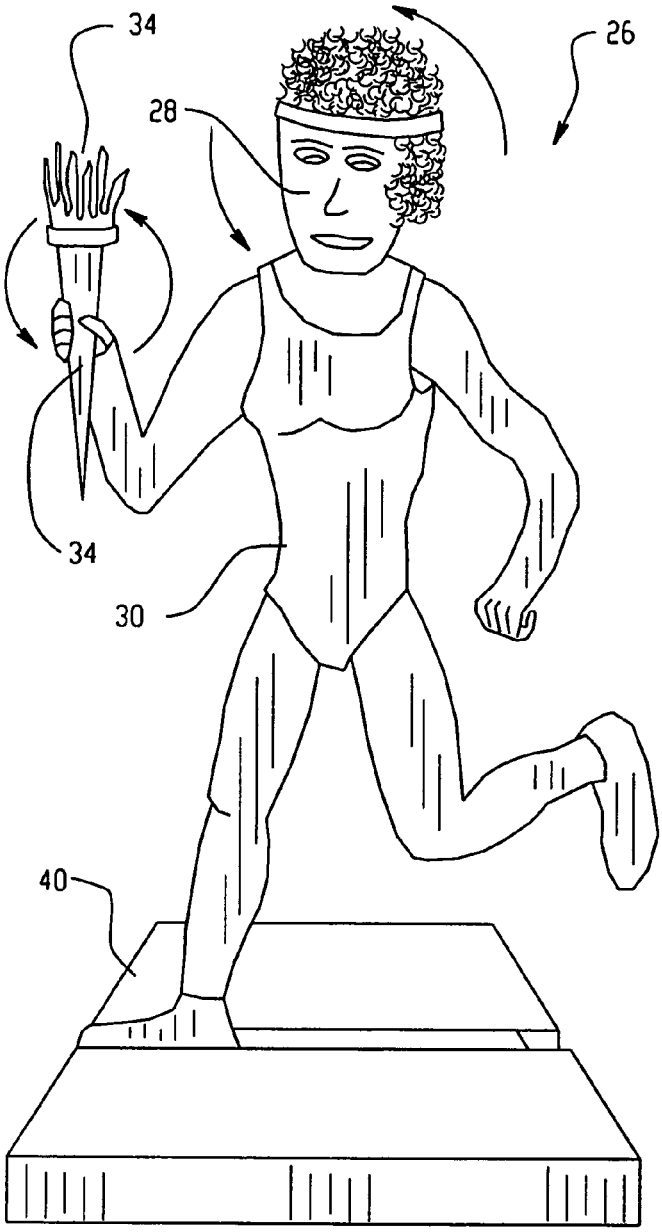
FIG. 6 illustrates a front view of another wobble head doll in accordance with an aspect of the present invention.
Figure 7:
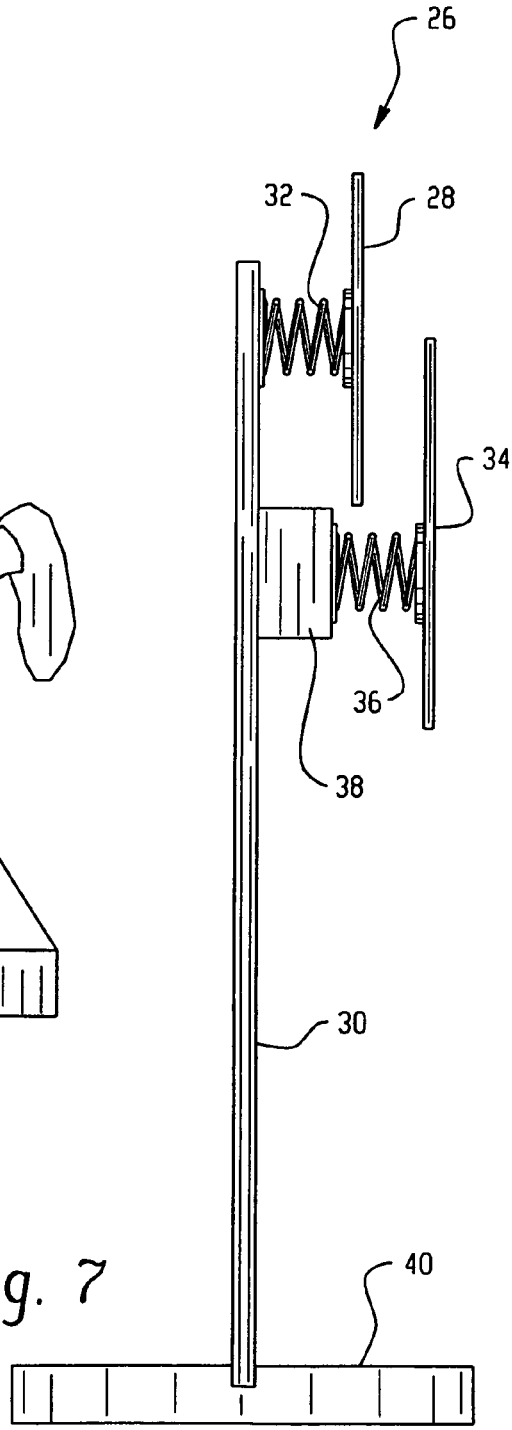
FIG. 7 illustrates a side view of the wobble head doll of FIG. 6 showing multi level/multi wobble elements in accordance with an aspect of the present invention.
Figure 8:
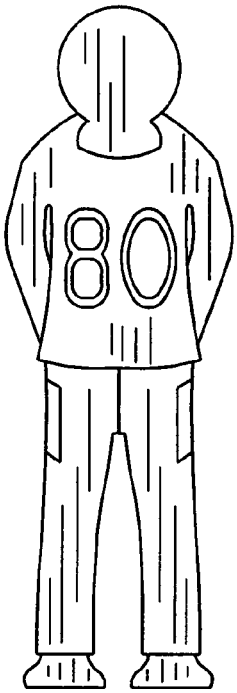
FIG. 8 illustrates a front view of an example of a wobble head doll design in accordance with an aspect of the present invention.
Figure 9:
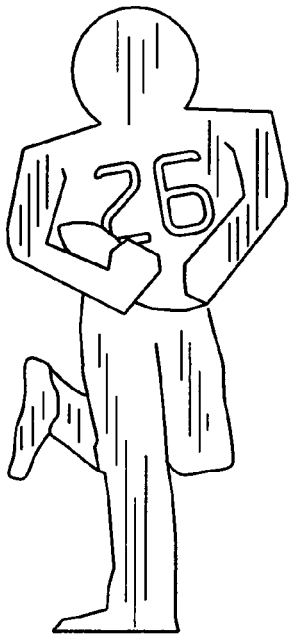
FIG. 9 illustrates a front view of another example of a wobble head doll design in accordance with an aspect of the present invention.
Figure 10:
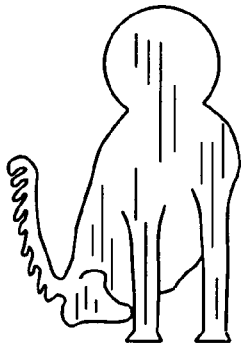
FIG. 10 illustrates a front view of another example of a wobble head doll design in accordance with an aspect of the present invention.
Figure 11:
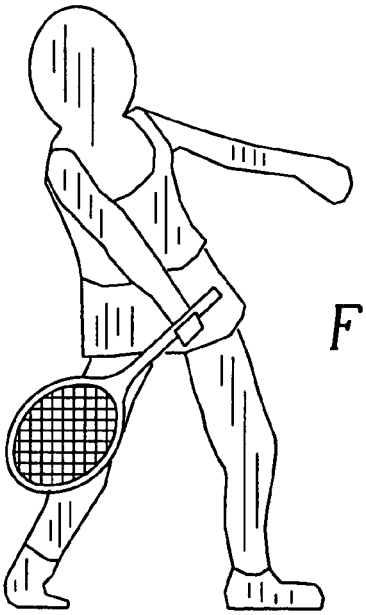
FIG. 11 illustrates a front view of another example of a wobble head doll design in accordance with an aspect of the present invention.
Figure 12:
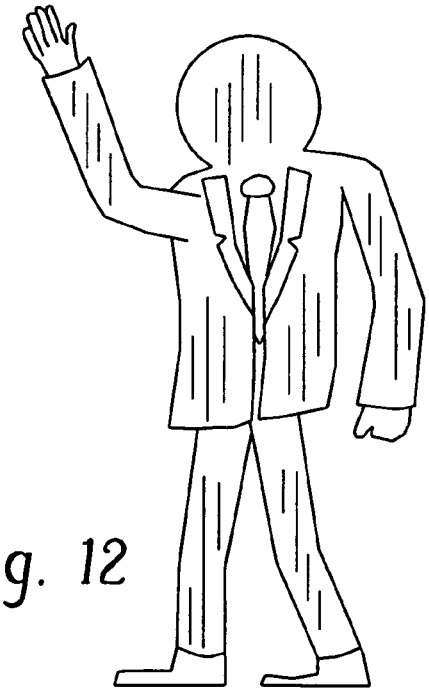
FIG. 12 illustrates a front view of another example of a wobble head doll design in accordance with an aspect of the present invention.

As yet another example, FIGS. 6 and 7 illustrate a wobble head doll 26 having a head 28 attached to a body 30 via a first spring 32 to provide a wobble movement of the head 28. The doll 26 further includes a secondary object, a torch in this example, 34 attached to the body 30 via a second spring 36 to provide a wobble movement of the torch. A spacer 38 can also be included to provide an additional space for a second object/image to wobble or wiggle while also giving added dimension to the wobble head doll 26. The doll 26 is supported by a base 40 in a manner similar to that described with respect to FIGS. 4 and 5.

FIGS. 8-12 illustrate various bodies or backgrounds that can be employed with the wobble head mounting assembly 10 and head 22 combinations. The bodies can be constructed from gloss printed color and/or black and white images and are mounted onto one of a variety of materials, such as pressboard, foam core, plastic, metal, wood, etc. A pose of the body can capture an action related to the image. Poses can be of any size, with standard models measuring up to 14" high depending upon an action captured in the pose. However, it is to be appreciated that the action bodies can be preprinted, die cut, action/animated body styles of any shape, thickness, size or material and is contemplated as falling within the scope of the present invention.

As discussed above, the body and/or background can be supported by inserting a bottom portion of the body into a slot in a base. For example, the base can be a 4 in×5 in×¾ in black gator foam, which is self skinned for strength and durability. The slot in the base corresponds with a thickness of the body or background employed with the base; thereby allowing insertion of the wobble head doll into the slot. By varying the overall size and adding additional slots, the base becomes a platform for multiple figures, themed backgrounds, commercial messages, etc. The slots can be of any suitable size and can be positioned horizontally, vertically, and/or angled within the base. Further, the base can include at least one recess (not shown) and at least one projection (not shown) in a side portion of the base such that at least two bases can be coupled together. However, the base can include any suitable structure employed to couple a plurality of bases together.

Figure 13:
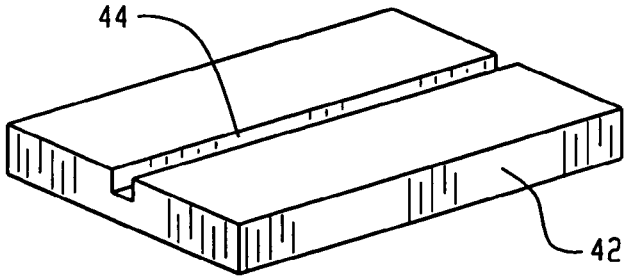
FIG. 13 illustrates a perspective view of a base having one slot in accordance with an aspect of the present invention.
Figure 14:
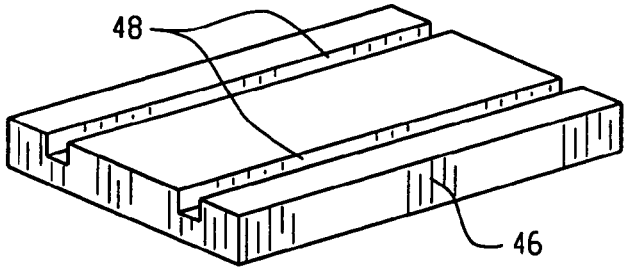
FIG. 14 illustrates a perspective view of a base having two slots in accordance with an aspect of the present invention.
Figure 15:
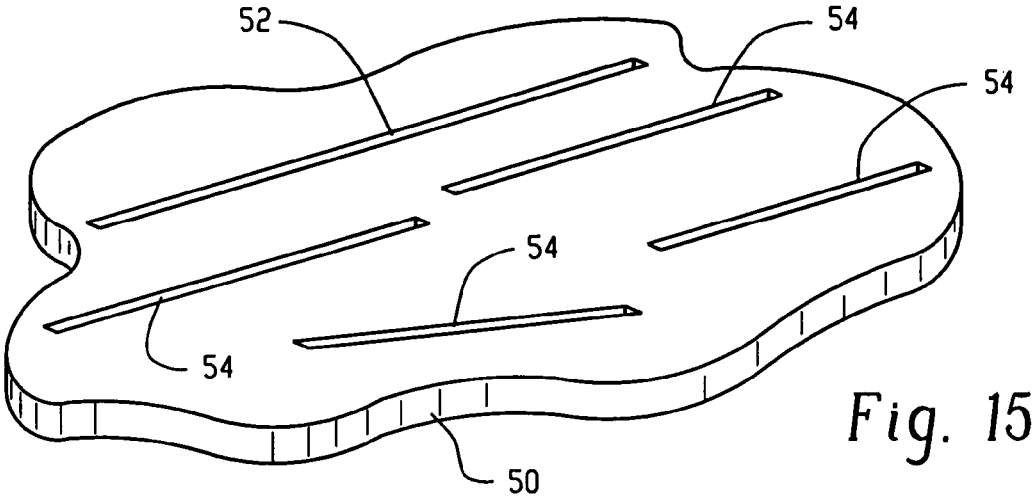
FIG. 15 illustrates a perspective view of a base having a plurality of slots in accordance with an aspect of the present invention.
Figure 16:
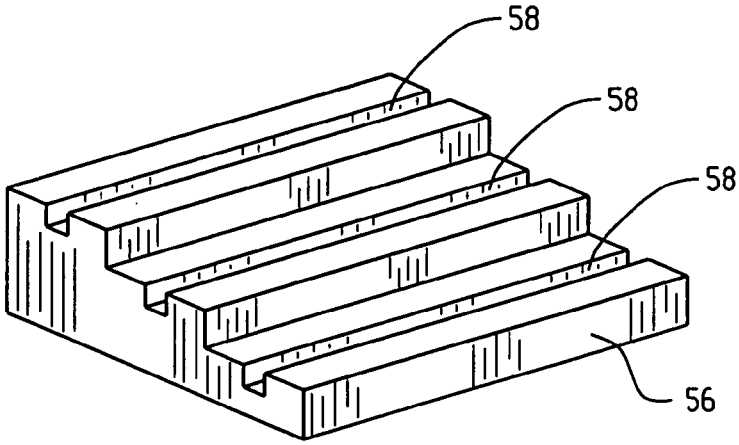
FIG. 16 illustrates a perspective view of a stepped base having a plurality of slots in accordance with an aspect of the present invention.

Turning now to FIGS. 13-16, a variety of bases that can be utilized with one or more wobble head dolls are depicted in accordance with an aspect of the present invention. FIG. 13 illustrates a base 42 having one slot 44 formed or cut through a top portion of the base 42 for mounting a single wobble head doll. For mounting two wobble head dolls back to back, or two wobble head dolls of different heights (e.g., a boy and a dog), a base 46 having two slots 48 provided therein, as shown in FIG. 14, can be utilized. As another example, FIG. 15 illustrates a base 50 having a slot 52 for a background scene and one or more slots 54 for one or more wobble head dolls. Thus, base 50 can be employed to display music groups, movie themes, sports teams, cartoon characters, etc. As yet another example, FIG. 16 illustrates a stepped base 56 having a plurality of levels, wherein each level includes a slot 58 for receiving one or more wobble head dolls. Accordingly, the stepped base 56 can be utilized for displaying sports teams, company staff, school classes, a history of presidents, etc.

Figure 17:
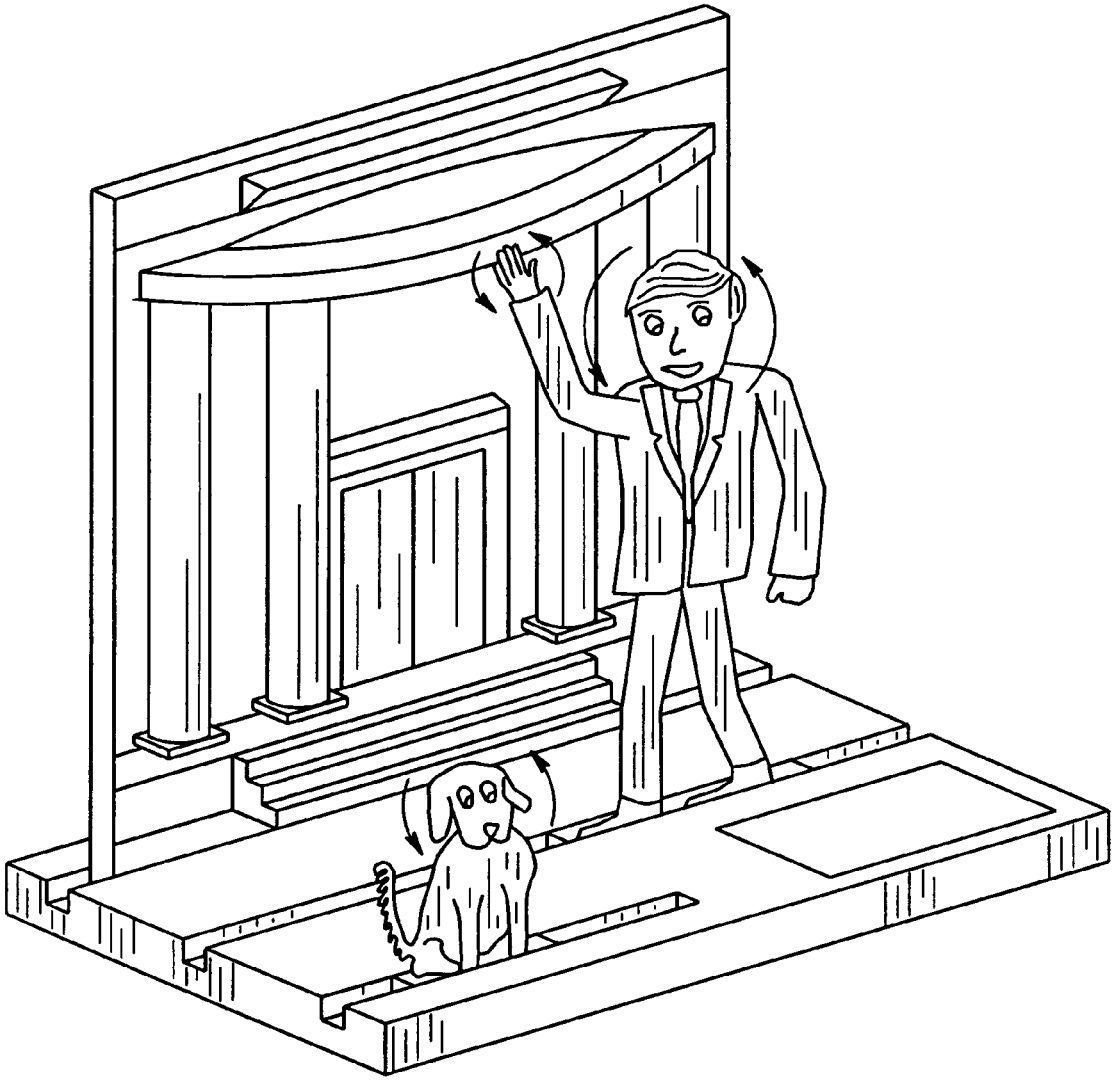
FIG. 17 illustrates a perspective view of a multi layered wobble head configuration in accordance with an aspect of the present invention.
Figure 18:
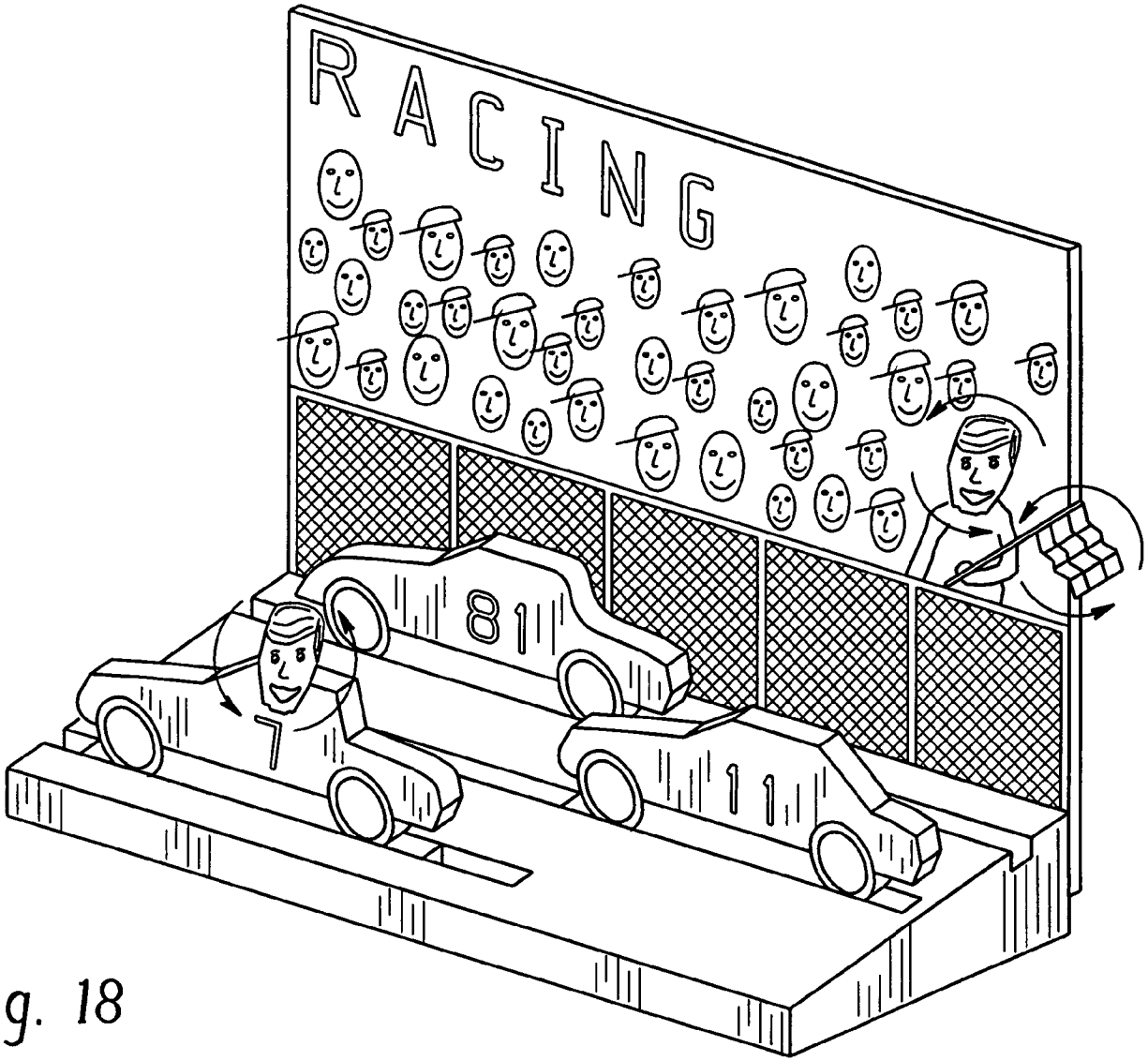
FIG. 18 illustrates a perspective view of a base in accordance with another aspect of the present invention.

FIGS. 17 and 18 illustrate examples of different scenes that can be created with the bases and wobbles of the present invention. Further, the backgrounds and/or wobble head dolls can be arranged on a base such that a plurality of wobbles can be displayed on a plurality of sides of the base. The wobble objects and/or background images can also be configured to move with respect to the base, as will be discussed in greater detail below. For example, in FIG. 18, the cars can be configured to move back and forth with respect to the base to create a visual image that the cars are traveling along a racetrack.

Figure 20:
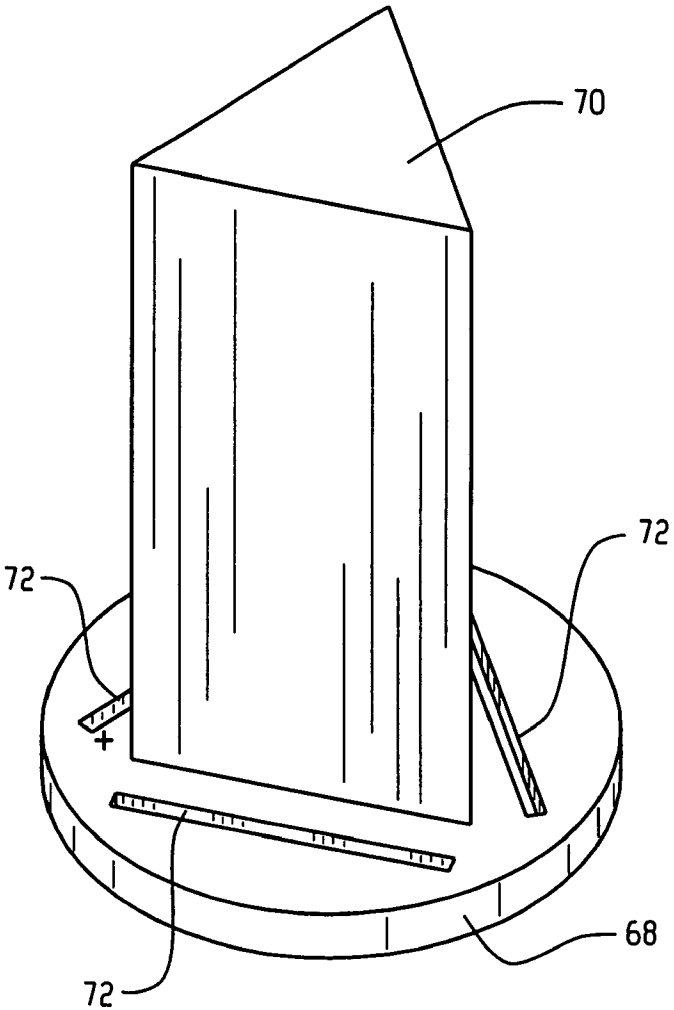
FIG. 20 illustrates a perspective view of a base in accordance with another aspect of the present invention.
Figure 19:
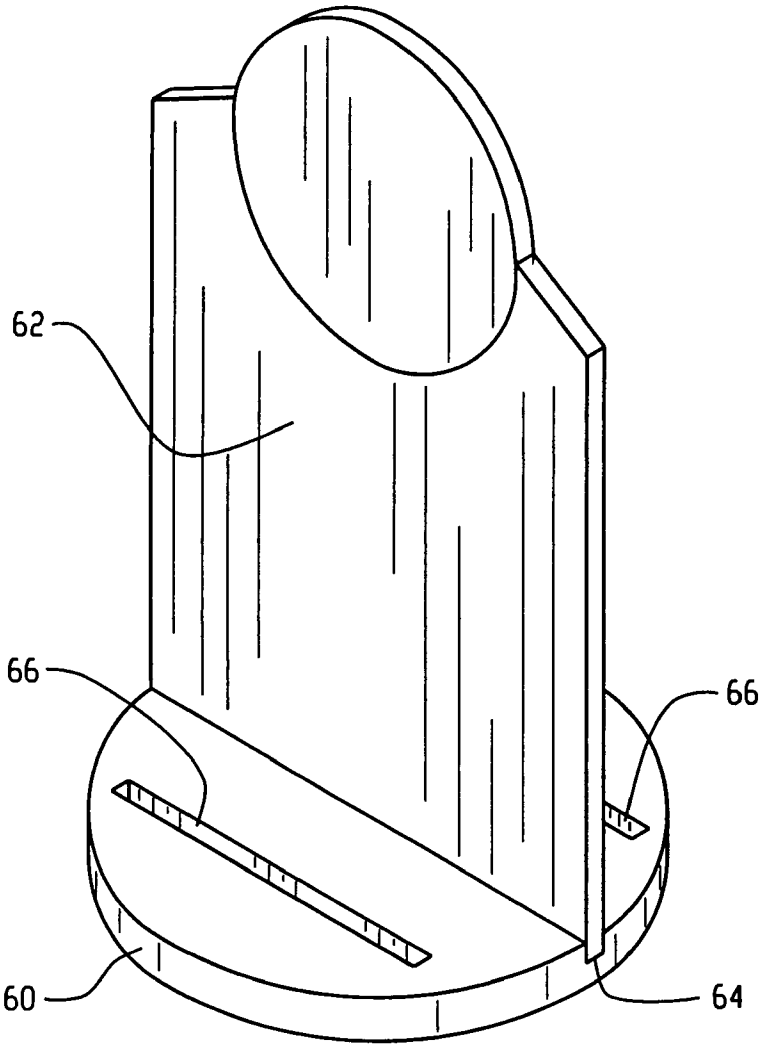
FIG. 19 illustrates a perspective view of a base in accordance with another aspect of the present invention.

FIG. 19 illustrates a base 60 in which a dual-sided background 62 can be inserted into a center slot 64 and two or more wobble head dolls can be inserted in slots 66 located on either side of the background 62. FIG. 20 illustrates a base 68 that can be employed with a multi-sided background structure 70. One or more wobble head dolls can be positioned in slots 72 located forward of the background structure 70. It is to be appreciated that any base configuration having any number of slots arranged in any manner can be employed and is contemplated as falling within the scope of the present invention.

Figure 21:
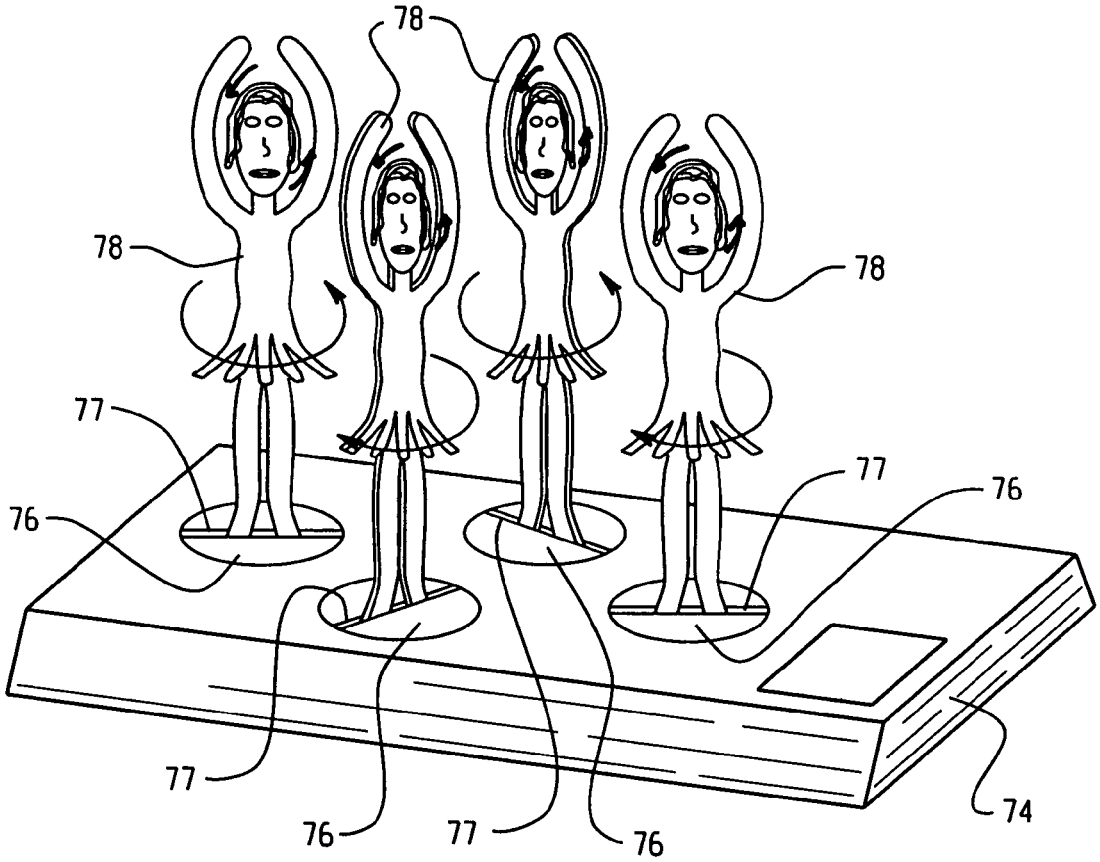
FIG. 21 illustrates a perspective view of a base in accordance with another aspect of the present invention.
Figure 22:
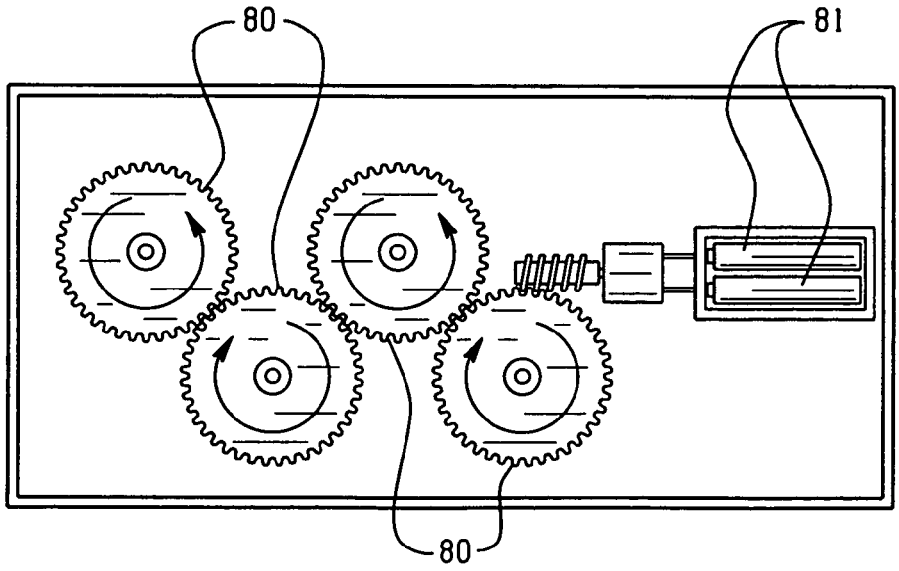
FIG. 22 illustrates a perspective view of a base in accordance with another aspect of the present invention.

FIGS. 21 and 22 illustrate a base 74 for one or more wobble head dolls 78 in accordance with another aspect of the present invention. The base 74 includes one or more turntable portions 76 that are operable to rotate the wobble head doll(s) 78 in a clockwise and/or counterclockwise circular motion. The rotation activates a wobble motion of a head and/or other feature of the wobble head doll(s) 78. A top portion of each of the turntables 76 has at least one slot 77 provided therein for supporting the wobble head doll(s) 78. At a bottom portion of the turntables 76, a plurality of gear teeth 80 are provided along an outer periphery of each of the turntables 76. Accordingly, when two or more turntables 76 are employed, the turntables 76 can be engaged with each other such that only one turntable 76 needs to be powered to effectively rotate all of the turntables 76. Batteries 81, or any other suitable power source, such as solar, magnetic, electric, microchip, etc., can power the turntables 76. Alternatively, the turntables 76 can be manually rotated via a crank structure, or the like.

Figure 23:
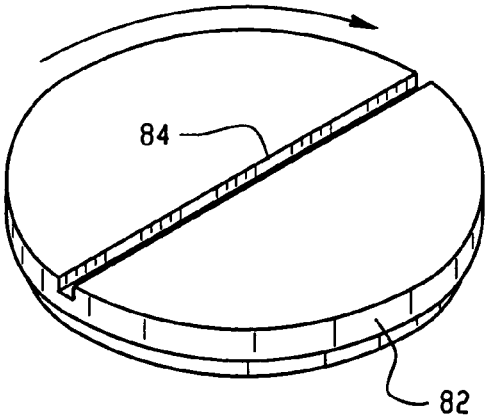
FIG. 23 illustrates a perspective view of a base in accordance with another aspect of the present invention.
Figure 24:
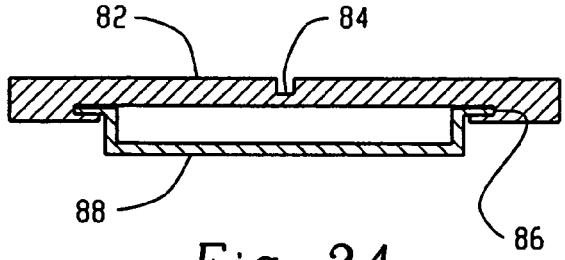
FIG. 24 illustrates a perspective view of a base in accordance with another aspect of the present invention.

Turning now to FIGS. 23 and 24, another base 82 for rotating one or more wobble head dolls is depicted in accordance with yet another aspect of the present invention. The base 82 has at least one slot 84 provided in a top portion of the base 82 and a circular recess 86 provided in a bottom portion of the base 82. The slot(s) 84 is configured to support one or more wobble head dolls positioned in the slot(s) 84. The circular recess 86 at the bottom portion of the base 82 is positioned over a cylindrical support 88 such that the base 82 is operable to spin freely on the support 88, thereby spinning the wobble head doll(s) and activating a wobble motion of a head and/or other feature of the doll(s).

It is to be appreciated that the rotatable bases described with respect to FIGS. 21-24 can include base or turntable portions of any desirable configuration. For instance, the base 74 can include turntable portions that include dual sided or multi sided background images with two or more wobble dolls, similar to the bases illustrated and described with respect to FIGS. 19 and 20.

Figure 25:
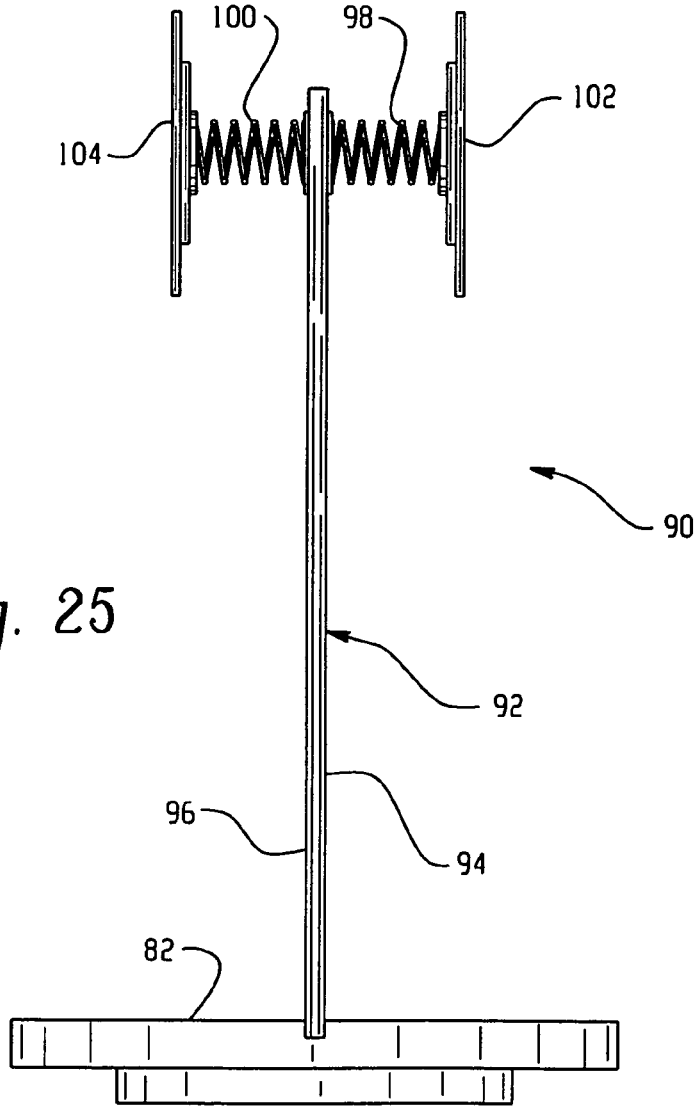
FIG. 25 illustrates a side view of a rotatable wobble head doll in accordance with an aspect of the present invention.
Figure 26:
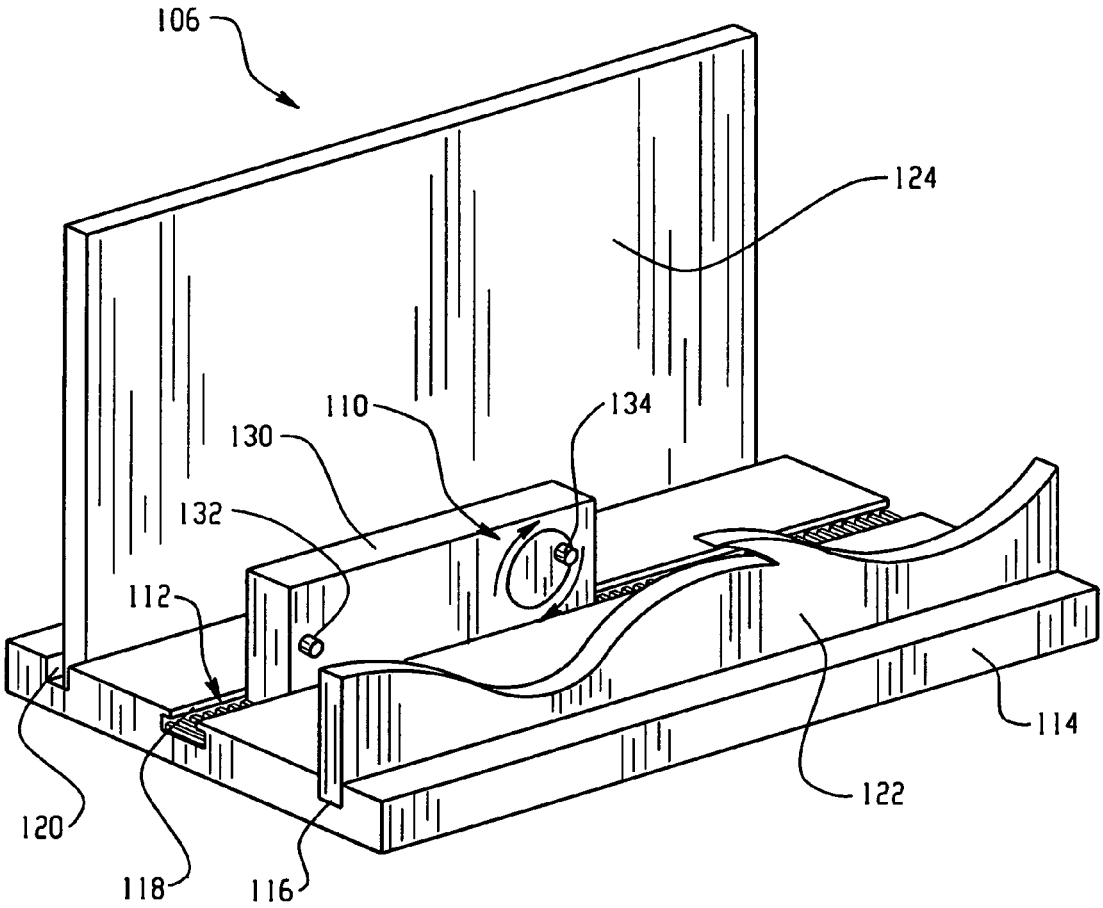
FIG. 26 illustrates a perspective view of an action wobble assembly in accordance with an aspect of the present invention.
Figure 27:
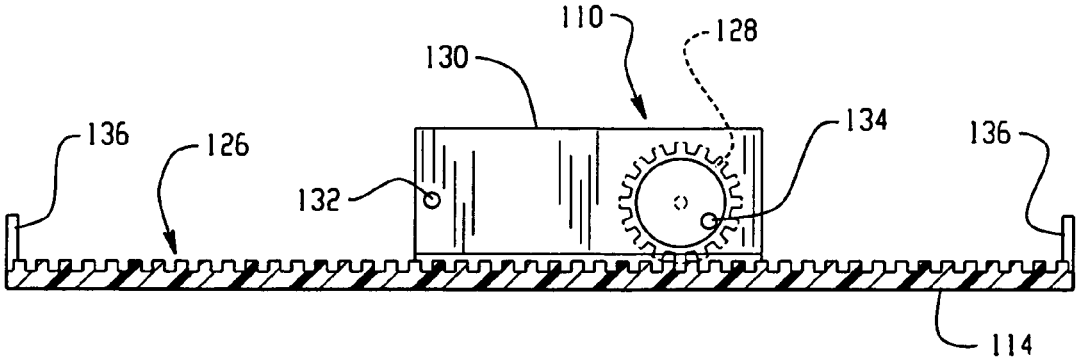
FIG. 27 illustrates a cross sectional view of the action wobble assembly of FIG. 26 in accordance with an aspect of the present invention.
Figure 28:
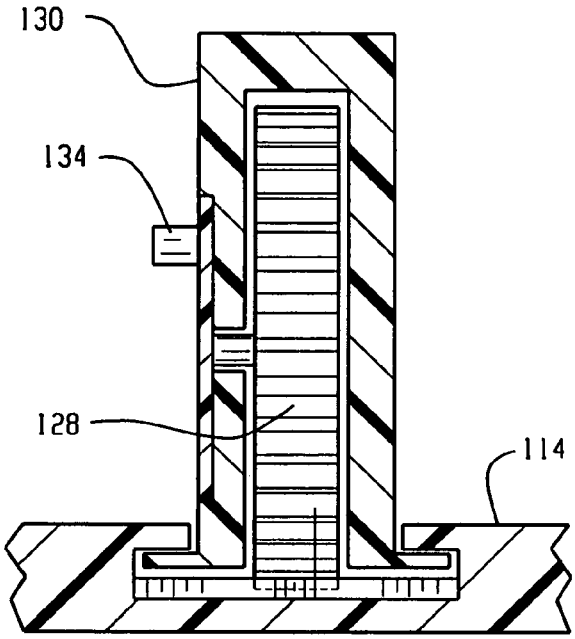
FIG. 28 illustrates a side view of the action wobble assembly of FIG. 26 in accordance with an aspect of the present invention.
Figure 29:
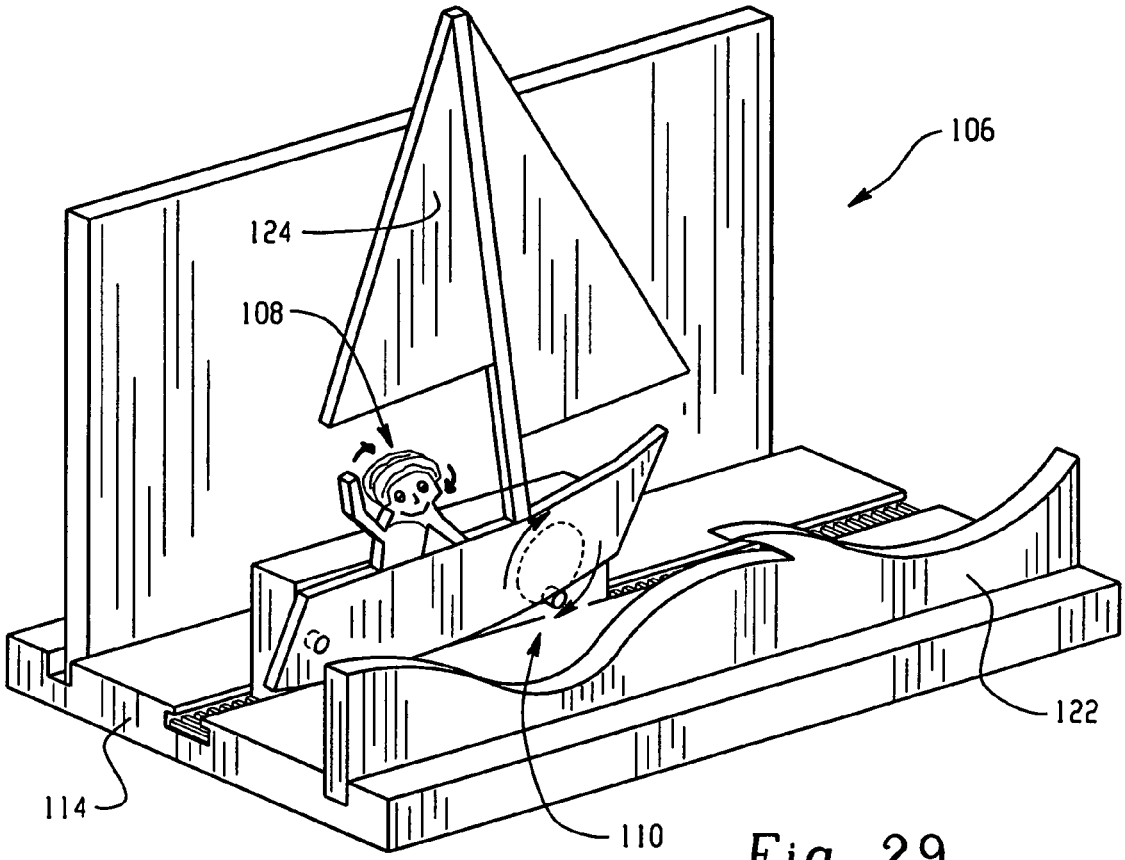
FIG. 29 illustrates a perspective view of an action wobble assembly in accordance with an aspect of the present invention.

With the spinning assemblies of FIGS. 21-24, or with any other assembly, a wobble head doll having both front and back sides is desired. Accordingly, FIG. 25 illustrates a wobble head doll 90 having a body portion 92 with a first side 94 and a second side 96. The first side 94 is printed with an image of a front side of a body. Likewise, the second side 96 is printed with an image of a back side of a body. At a head portion of the body 92, or any other suitable portion, first and second mounting assemblies 98, 100 are secured to the first and second body sides 94, 96, respectively. A facial image 102 is secured to the first mounting assembly 98 and a back of the head image 104 is secured to the second mounting assembly 96. Thus, when the wobble head doll 90 spins on a base 106, a user views both front and back images of the doll 90. It is to be appreciated that in the alternative, a doll having two front images with two wobble faces can be utilized.

Although, a plurality of bases have been described herein as having rotating portions for spinning the wobble head dolls, it is to be appreciated that bases can also be configured to bounce, slide, or otherwise move one or more wobble head dolls. For example, FIGS. 25-28 illustrate a wobble assembly 106 which is animated by employing an action wobble head 108 in combination with a rocking motion, provided by a battery powered cam 110, and a linear motion, provided by a gear driven track 112. The wobble assembly 108 includes a base 114 having one or more slots provided therein. In this example, the base 114 has three slots 116, 118, and 120. Slots 116 and 120 are employed to secure a fixed foreground scene 122 and a fixed background scene 124, respectively. Slot 118, on the other hand, includes a slotted track portion 126 for engaging teeth of a wheel 128 located on or within a motion carriage 130. Accordingly, the motion carriage 130 is able to move linearly along a length of the slot 118. The slot 118 can include bumpers 136 at end portions of the slot 118 to prevent the motion carriage 130 from moving off the track 126. The motion carriage 130 includes a first projection 132 for mounting a wobble head body or wobble vehicle thereto. The first projection 132 acts as a pivot point for the wobble head body or vehicle. The wheel 128 in the motion carriage 130 includes a second projection 134, which moves in a circular motion as the wheel 128 moves along the track 126. A portion of the action wobble head 108 can be positioned to rest on the second projection 134. Thus, as the second projection 134 moves in a circular motion, the end portion of the wobble head body or vehicle moves in a rocking motion, while pivoting about the first projection 132. The motion of the wheel 128 can be battery powered and/or manually activated.

As an alternative to, or in addition to, a microchip provided in a mounting assembly for a wobble head, a base could include a microchip for voice activation and audio output. Thus, a wobble head assembly can include a pre-recorded or recordable greeting, an animal sound (e.g., dog barks, cat meows), a car horn beeping, music, etc.

Figure 30:
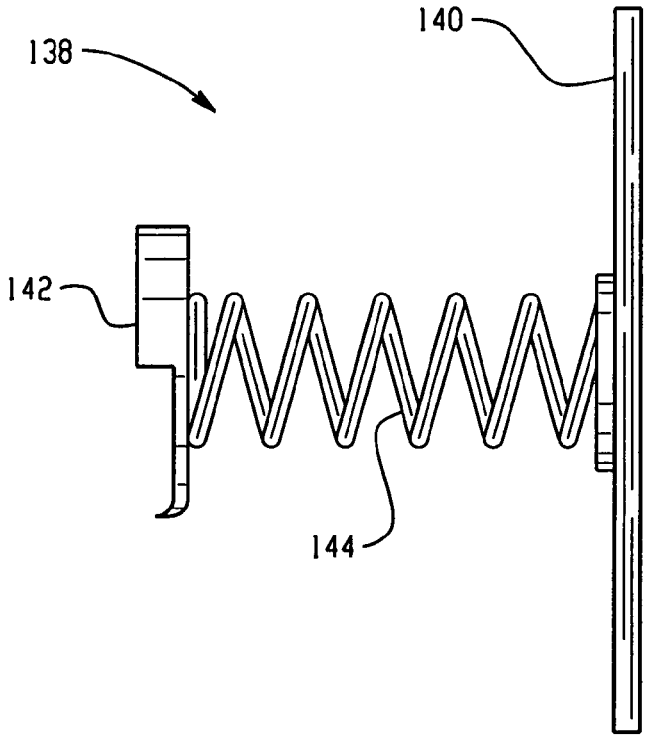
FIG. 30 illustrates a perspective view of a mounting assembly for a wobble image in accordance with an aspect of the present invention.

Although wobble heads have been described herein as being attached to a body or background image, it is to be appreciated that a wobble head can be provided with a magnet, suction cup, hook and loop fastener, snaps, rivets, buttons, or any other fastening device to couple the wobble head to clothing, appliances, computers, office equipment, furniture, vehicles, windows, mirrors, bulletins and wipe boards, or any other suitable material or structure. FIGS. 30-33 illustrate various mounting assemblies that are employed to couple the wobble heads to different materials or structures. FIG. 30 depicts a button mounting assembly 138 in accordance with an aspect of the present invention. The button mounting assembly 138 includes a mounting plate 140 coupled to a button shroud 142 via a spring 144. The spring 144 can be secured to the mounting plate 140 and button shroud 142 via an epoxy resin (not shown). Thus, an image can be attached to the mounting plate 140 and the entire assembly can be securely positioned over a button, such as on an article of clothing.

Figure 31:
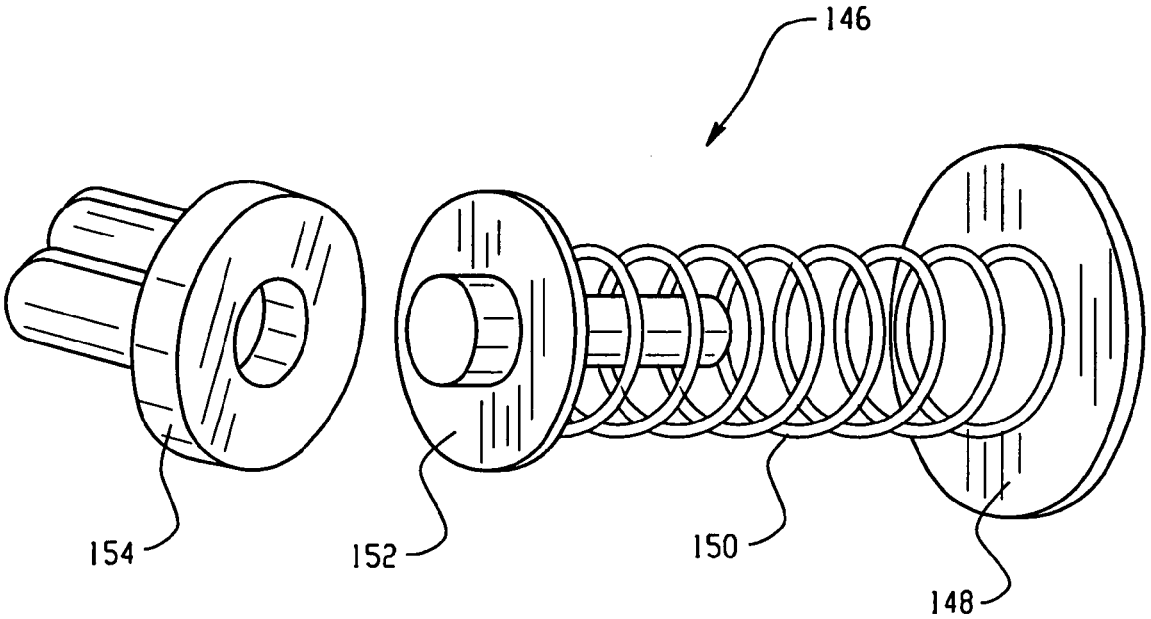
FIG. 31 illustrates a perspective view of another mounting assembly for a wobble image in accordance with an aspect of the present invention.

FIG. 31 illustrates a snap assembly 146 that can be employed to secure a wobble head to clothing, hats, accessories, etc. The snap assembly 146 includes a first mounting plate 148 for securing a photograph or other image thereto. The first mounting plate 148 is coupled to a first end of a spring 150 to provide a wobble movement for the photograph or image. A first snap portion 152 is coupled to a second end of the spring 150 and is configured to correspond with a second snap portion 154. Thus, the snap assembly 146 can be employed by placing the second snap portion 154 on one side of an article of clothing and the first snap portion 154 on an opposing side, to secure the wobble assembly to the clothing. The first and second snap portions 152, 154 can include magnets to facilitate coupling of the snap assembly 146.

Figure 32:
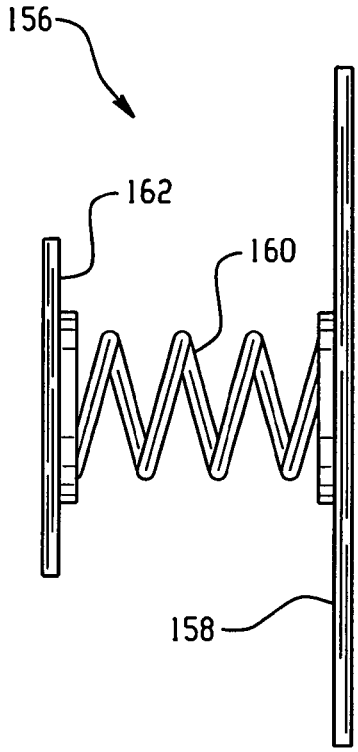
FIG. 32 illustrates a perspective view of another mounting assembly for a wobble image in accordance with an aspect of the present invention.

FIG. 32 illustrates a magnetic assembly 156 for securing a wobble head to an appliance, a vehicle, etc. The magnetic assembly 156 includes a first mounting plate 158 for securing a photograph or other image thereto. The first mounting plate 158 is coupled to a first end of a spring 160 to provide a wobble movement for the photograph or image. Secured to a second end of the spring 160, is a magnet 162 for coupling the wobble head assembly to a metal surface.

Figure 33:
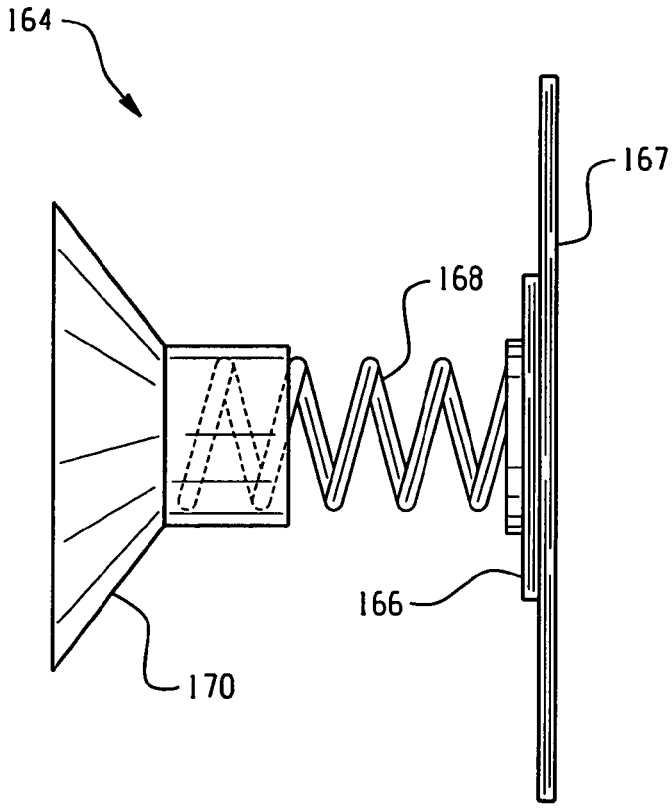
FIG. 33 illustrates a perspective view of another mounting assembly for a wobble image in accordance with an aspect of the present invention.

FIG. 33 illustrates a suction cup assembly 164 that allows a wobble item to be displayed in numerous locations. The suction cup assembly 164 includes a mounting plate 166 for securing a photograph or other image 167 thereto. The mounting plate 166 is coupled to a first end of a spring 168 to provide a wobble movement for the photograph or image 167. A suction cup 170 is secured to a second end of the spring 168. Thus, the wobble item can be secured to mirrors, windows, appliances, message boards, computers, etc. Motion in a room, a breeze, or vibration can activate a wobble motion for the item.

Turning now to FIG. 33, a twist cam 172 for a wobble head is shown in accordance with an aspect of the present invention. The twist cam 172 includes a cam and slot configuration to provide a side-to-side twisting motion of a wobble head secured thereto. A mounting plate 174 is coupled to an end portion of at least one projection 176, preferably two projections, which extend through a slotted opening 178 in a first side of a cam housing 180. Thus, the cam housing 180 can move with respect to the mounting plate 174 as dictated by the slotted opening 178. In this example, the slotted opening 178 is substantially curvilinear to provide a twisting motion. A photograph or image 182 is secured to a second side of the cam housing 180 via an adhesive, fastener, or the like.

Figure 34:
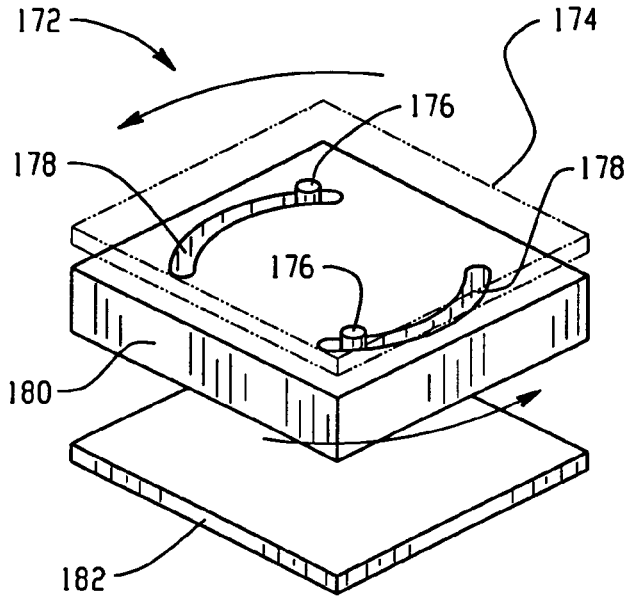
FIG. 34 illustrates a perspective view of a twist cam assembly for a wobble image in accordance with an aspect of the present invention.
Figure 35:
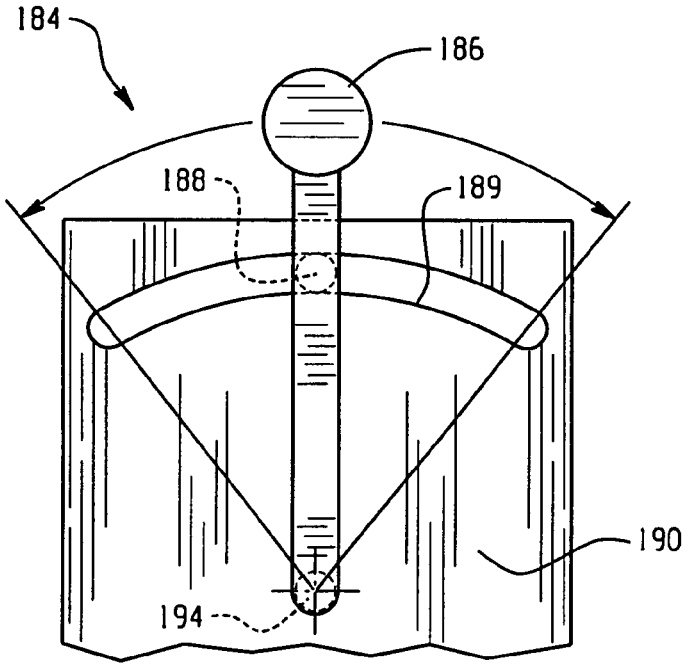
FIG. 35 illustrates a perspective view of a pendulum assembly for a wobble image in accordance with an aspect of the present invention.
Figure 36:
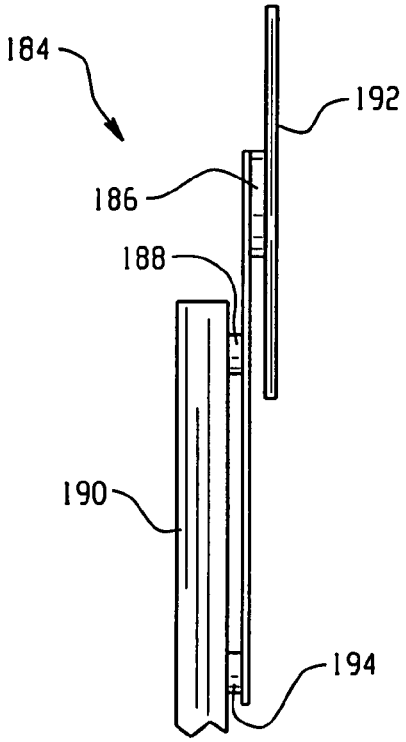
FIG. 36 illustrates a side view of the pendulum assembly of FIG. 34 in accordance with an aspect of the present invention.

FIGS. 34 and 35 illustrate a pendulum assembly 184 for a wobble head in accordance with another aspect of the present invention. The pendulum assembly 184 includes a pendulum 186 coupled to a cam 188, which extends through a slotted opening 189 in a cam housing 190. The slotted opening 189 is configured to provide a side to side wobble motion for a photograph or image 192, which is secured to a free end portion of the pendulum 186. The pendulum 186 can also be provided with a spring force at the pendulum's pivot point 194. Thus, when the pendulum 186 is pulled to one side, a 'whipping' side-to-side action can be created.

Motions of the battery powered wobble head examples can be voice activated, motion activated, programmed to wobble at predetermined intervals and/or time periods, and/or manually activated.

Figure 37:
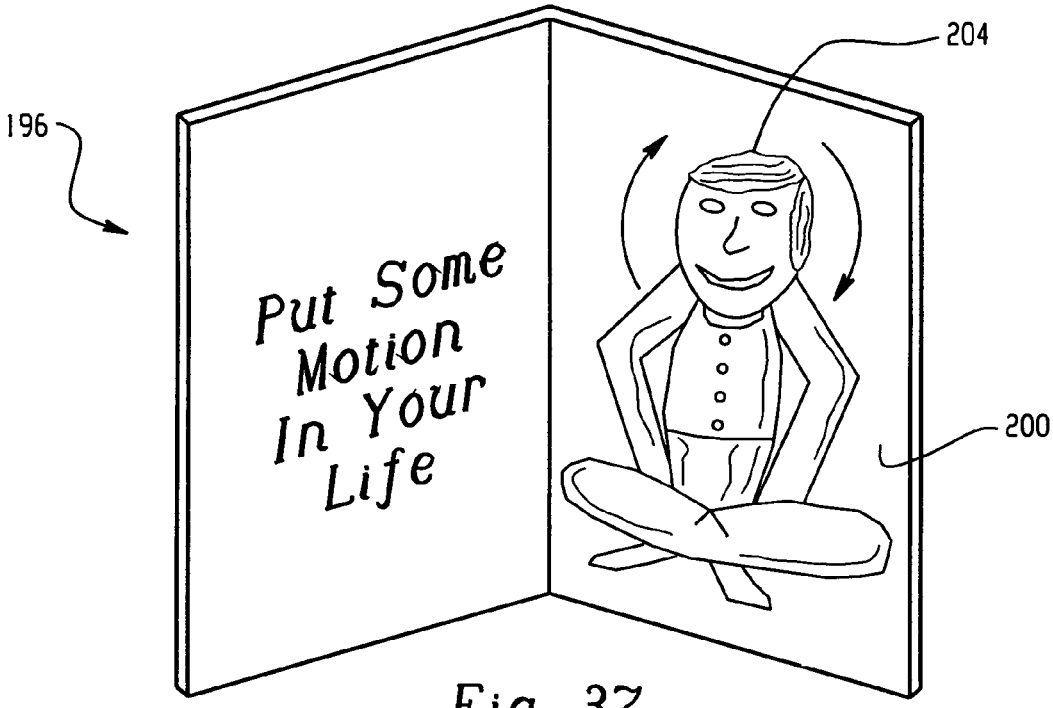
FIG. 37 illustrates a perspective view of a wobble image greeting card in accordance with an aspect of the present invention.
Figure 38:
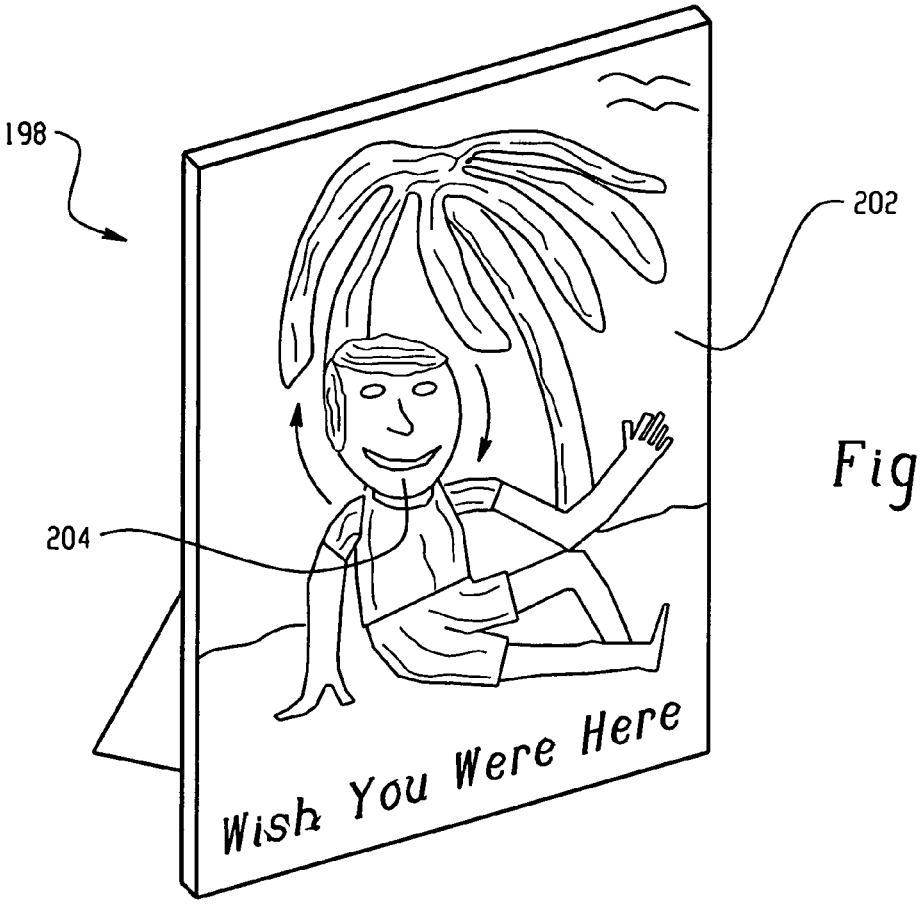
FIG. 38 illustrates a perspective view of an action wobble photo in accordance with an aspect of the present invention.
Figure 39:
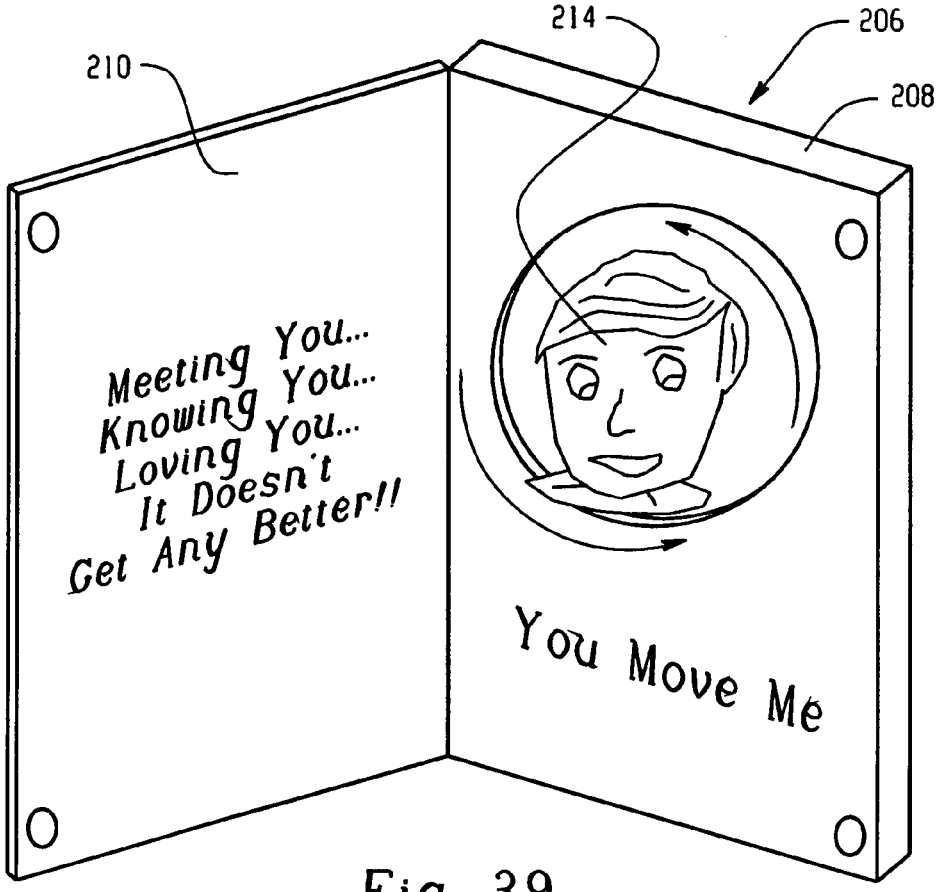
FIG. 39 illustrates a perspective view of a self-mailer wobble image greeting card in accordance with an aspect of the present invention.

The wobble head concept can be employed in a variety of different applications, as depicted in FIGS. 37 through 46. FIGS. 37-39 illustrate action wobble greeting cards. A greeting card can be in the form of a standard book format 196 (FIG. 37) or a photo easel format 198 (FIG. 38). In the standard book format, a 5"×7" image can be employed as a base 200. In the photo easel format 198, a photograph can be employed as a base 202. A wobble image 204 is then coupled to the base 200, 202 via a mounting assembly (not shown). If desired, a removable adhesive (not shown) can be placed between the wobble image 204 and the base 200, 202 to hold a spring of the mounting assembly in a compressed manner, thereby, protecting the wobble image 204 during shipping or mailing. When the card is received, a user can easily discard the removable adhesive to release the spring and set the wobble image 204 in motion. The greeting cards 196 and 198 can also house microchips to provide recorded messages, music, and/or voice activation.

Figure 40:
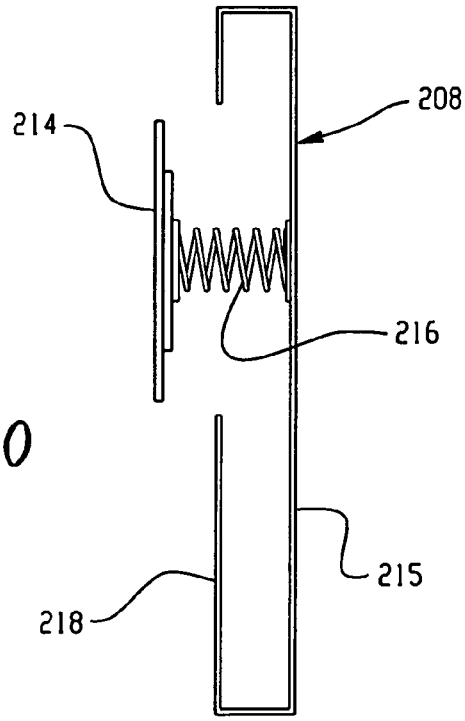
FIG. 40 illustrates a side view of the self-mailer wobble image greeting card in accordance with an aspect of the present invention.

Turning now to FIGS. 39 and 40, a self-mailer greeting card 206 is illustrated in accordance with an aspect of the present invention. The self-mailer greeting card 206 includes a spacer box 208 and a greeting panel 210. Hook and loop fasteners or removable adhesive dots 212 can be applied to corners of the spacer box 208 and greeting panel 210 to facilitate holding the greeting card 206 together during mailing. A mailing address is provided on an outside portion of either the spacer box 208 or the greeting panel 210. A wobble image 214 can be secured to an inner portion of a back panel 215 of the spacer box 208 via a spring 216, as depicted in FIG. 40. A front panel 218 of the spacer box includes a cut out portion such that the spring 216 can project through the front panel 218. The spacer box 208, thus, provides room for suitable compression of the spring 216 while still retaining its original properties. For example, the spacer box 208 can have a thickness of about three-eights of an inch. The spacer box 208 also provides room for one or more microchips, batteries, or the like.

Figure 41:
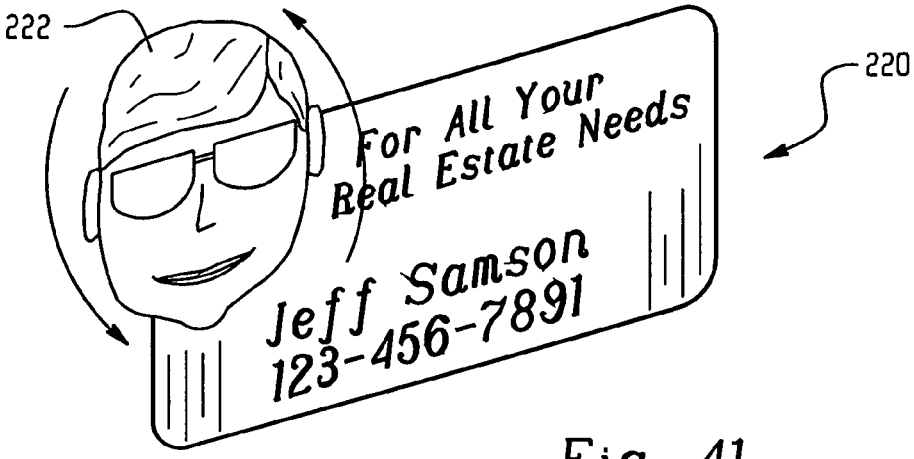
FIG. 41 illustrates a perspective view of wobble image stationary in accordance with an aspect of the present invention.

FIG. 41 depicts a wobble image employed on or as a stationary base 220. For example, a wobble image 222 can be employed as a business card 220 that can be secured to a refrigerator via a magnet mounting assembly. As another example, a wobble image 222 can be employed on a reminder/wipe board. Alternatively or additionally, the wobble image 222 can be employed as a reminder/wipe board. The reminder/wipe board includes desired image printed on photo paper with or without a personalized message. A clear "wipe-off" laminate is provided over a top portion of the image. Accordingly, text and images can be written on the wobble image as desired. A microchip can also be included on the stationary base (e.g., business card, reminder/wipe board) to provide programmable names, times, reminders, and/or sales messages.

Figure 42:
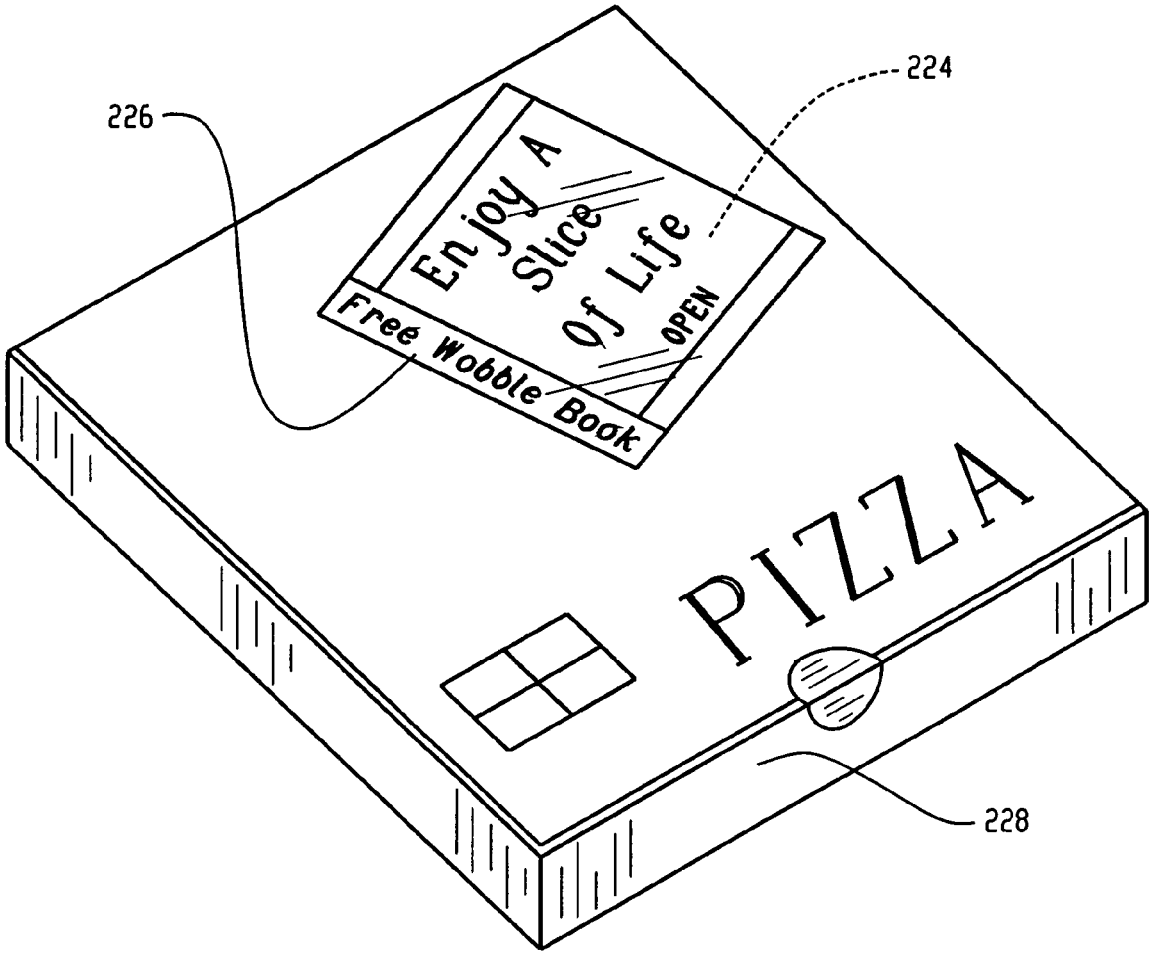
FIG. 42 illustrates a perspective view of a wobble image employed in advertising in accordance with an aspect of the present invention.
Figure 43:
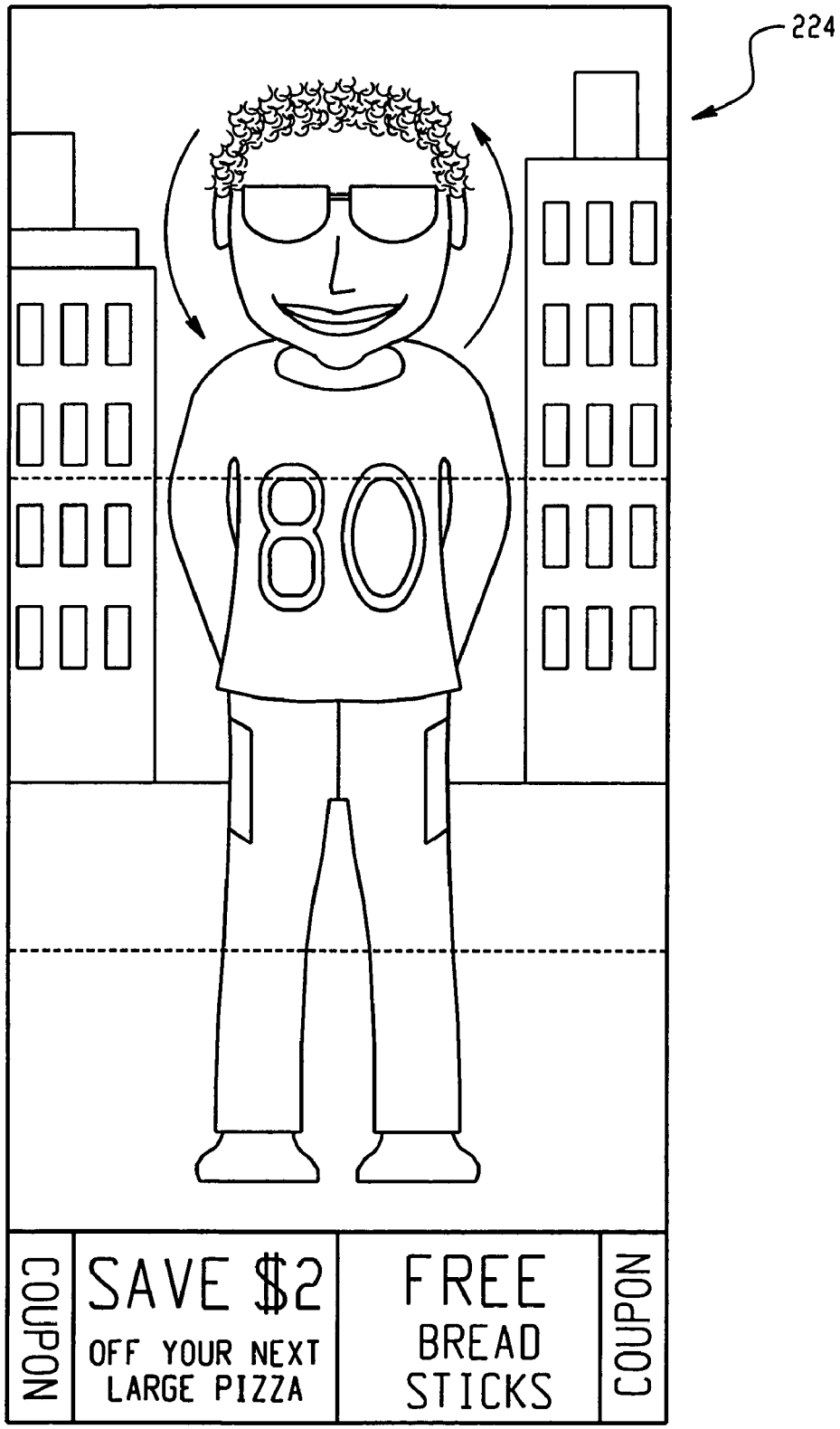
FIG. 43 illustrates a front view of a wobble image poster in accordance with an aspect of the present invention.

In FIGS. 42 and 43, a wobble image is shown employed in a commercial, or marketing, application. For example, a poster 224 having a wobble image and coupons thereon, can be enclosed within a pouch 226 on a pizza box 228, or any other item. A consumer can pull the folded poster 224 from the pouch to reveal the wobble image and/or coupons. The wobble image provides a unique, attention-getting design for sales or other advertising applications. For example, the wobble image can be employed in coupon offerings, posters, magazine and newspaper advertisements and any other suitable advertising settings.

Figure 44:
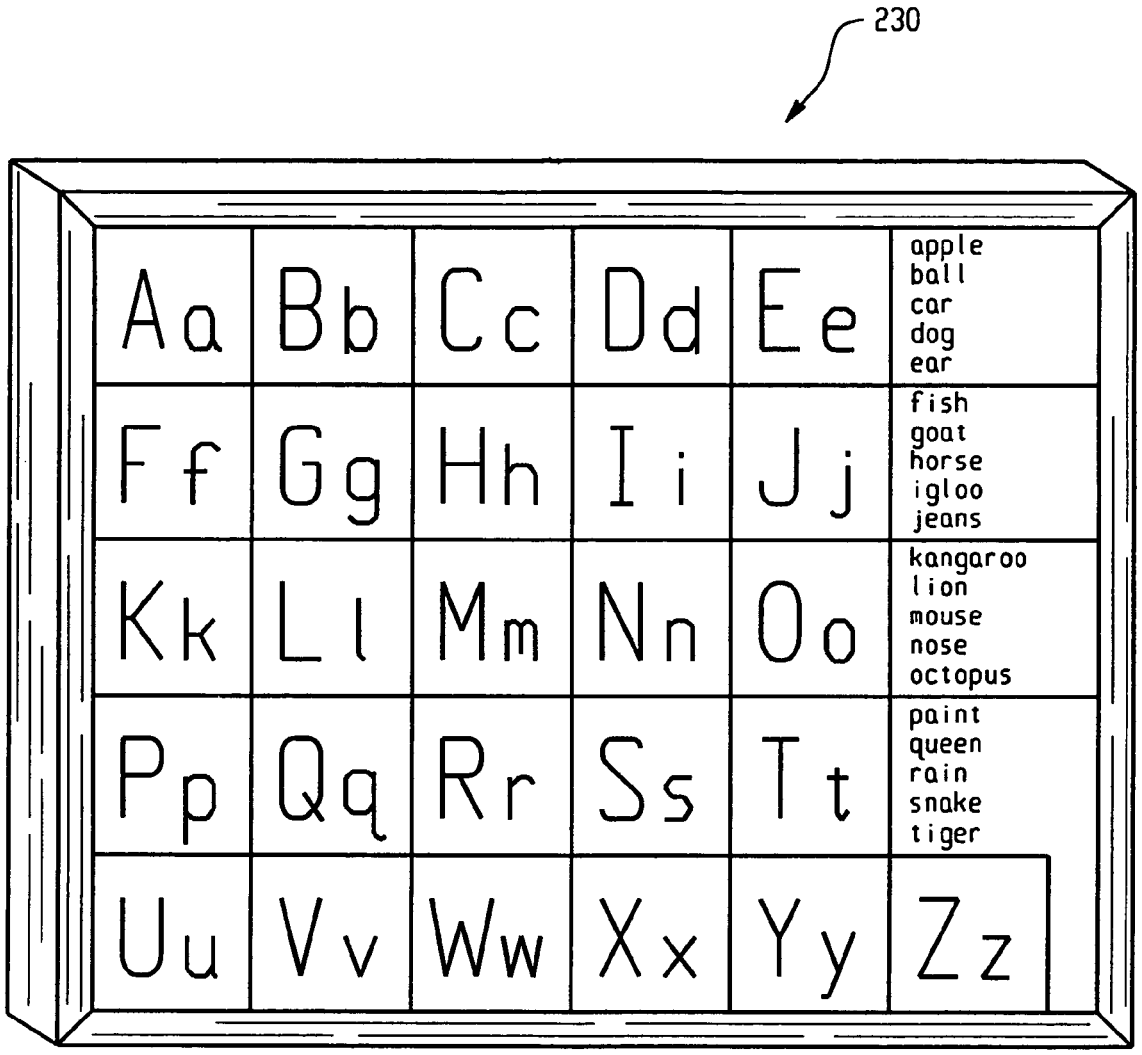
FIG. 44 illustrates an educational game employing wobble images in accordance with an aspect of the present invention.
Figure 44:
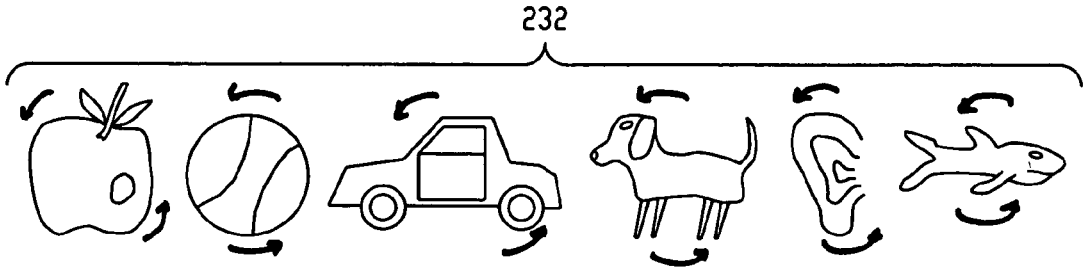

FIG. 44 illustrates wobble objects employed in educational products. The wobble objects can assist in teaching children the alphabet, numbers, history, geography, and vocabulary, for example. The wobble action of the objects facilitates in holding the interest of the children. For example, a board 230 can be provided with the alphabet. Pluralities of wobble images 232 whose first letter corresponds with a letter of the alphabet are provided as game pieces. Although not shown, each of the images 232 includes a mounting assembly thereon to provide a wobble motion for the image 232. The wobble images 232 can also be provided with one or more microchips to provide audio verification when the correct wobble image 232 is placed on the correct letter, thereby facilitating the learning process.

Figure 45:
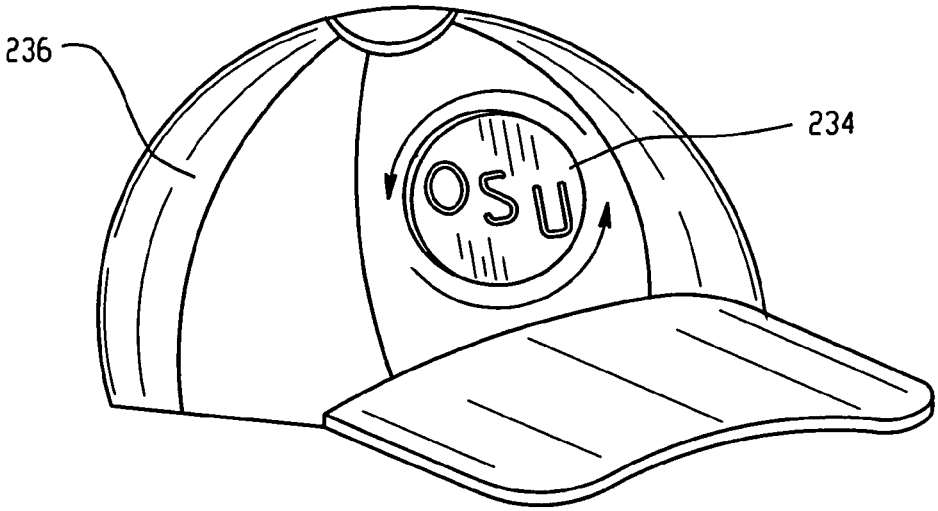
FIG. 45 illustrates a wobble image employed on a hat in accordance with an aspect of the present invention.
Figure 46:
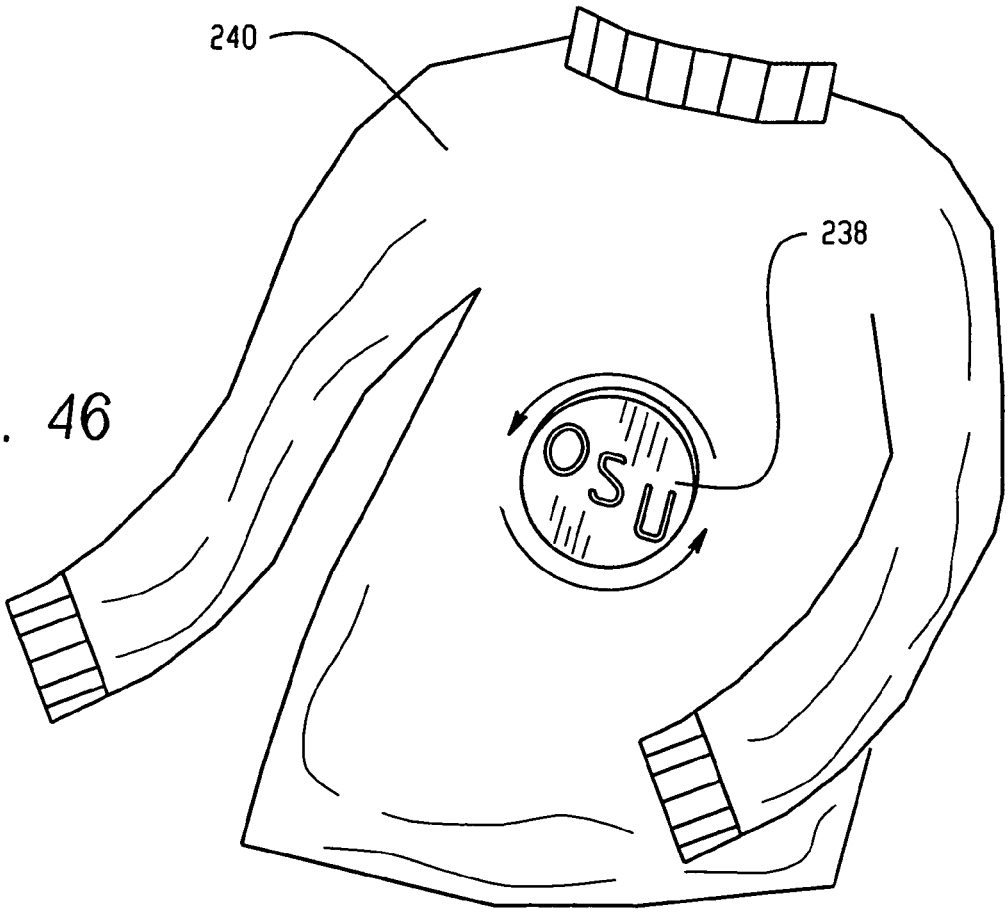
FIG. 46 illustrates a wobble image employed on clothing in accordance with an aspect of the present invention.

FIGS. 45 and 46 include wearable items having one or more wobble items secured thereto in accordance with an aspect of the present invention. In particular, FIG. 45 depicts a wobble item 234 coupled to a hat 236 and FIG. 46 depicts a wobble item 238 coupled to a shirt 240. The wobble items 234, 238 have mounting assemblies, such as the mounting assembly described with respect to FIG. 1 herein, attached thereto. The mounting assemblies can be secured to the hat 236 and shirt 240 via a hook and loop type faster, an adhesive, a snap assembly, or via any other suitable manner.

Although various wobble items have been shown and described in various applications herein, it is to be appreciated that any other application that can be employed with a wobble item is contemplated as falling within the scope of the present invention. For example, wobble items can be employed in and/or on CD and DVD cases, various clothing items, food items (e.g., boxes, cans, bags of food), books, etc.

Figure 47:
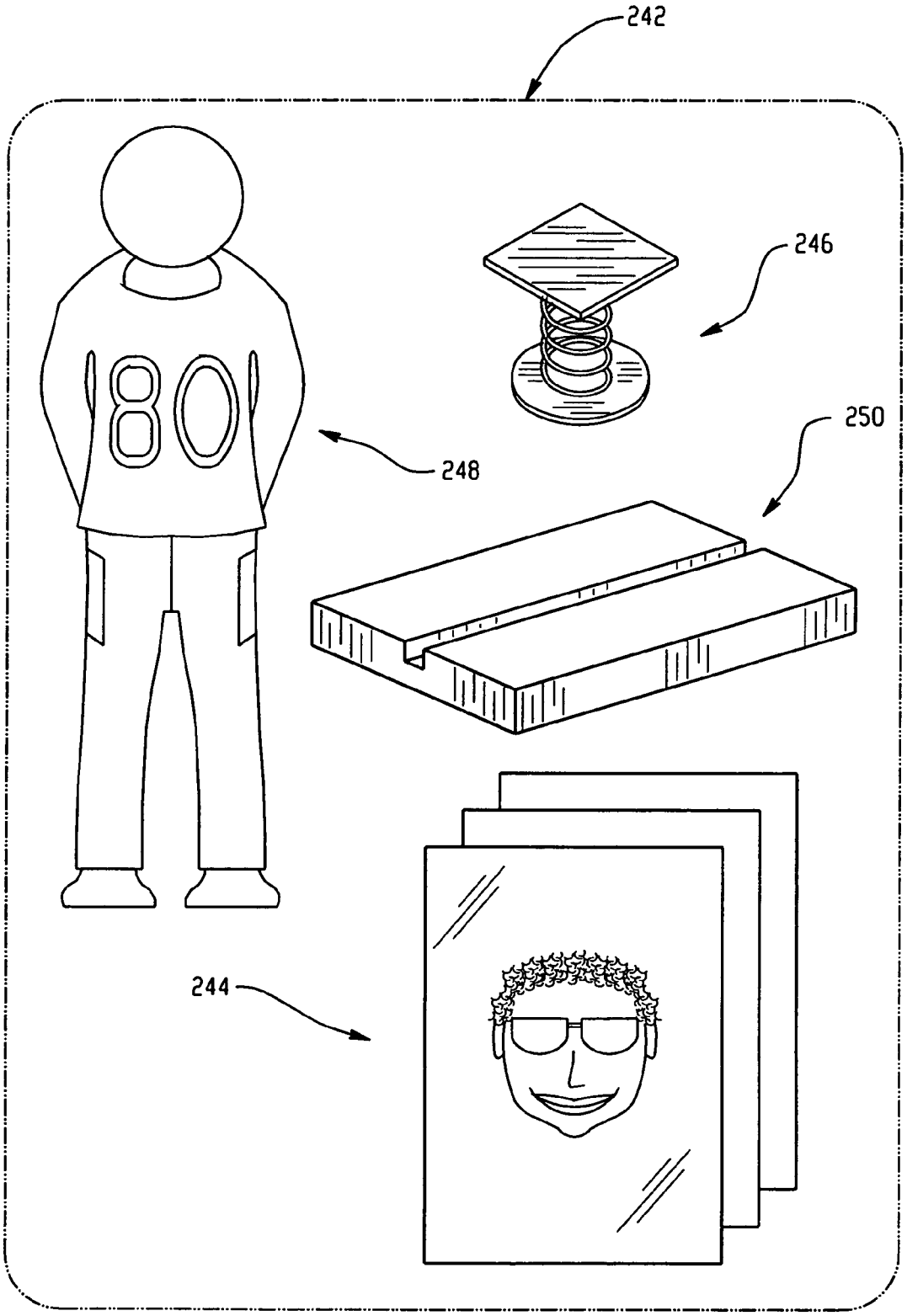
FIG. 47 illustrates a kit for creating wobble objects in accordance with an aspect of the present invention.

Turning now to FIG. 47, a kit 242 is illustrated for creating wobble objects. The kit 242 can include photo paper 244 for printing a desired image and at least one action wobble mounting assembly 246. A variety of fasteners (not shown) can also be provided for securing the wobble image to various surfaces and/or structures. For example, the fasteners can include snaps, hook and loop fasteners, magnets, etc. The kit 242 can also include one or more die cut action figures and/or backgrounds 248, as well as one or more bases 250 to support the figures and/or backgrounds. Alternatively, or additionally, the kit can include cardstock (not shown) to create greeting cards.

Figure 48:
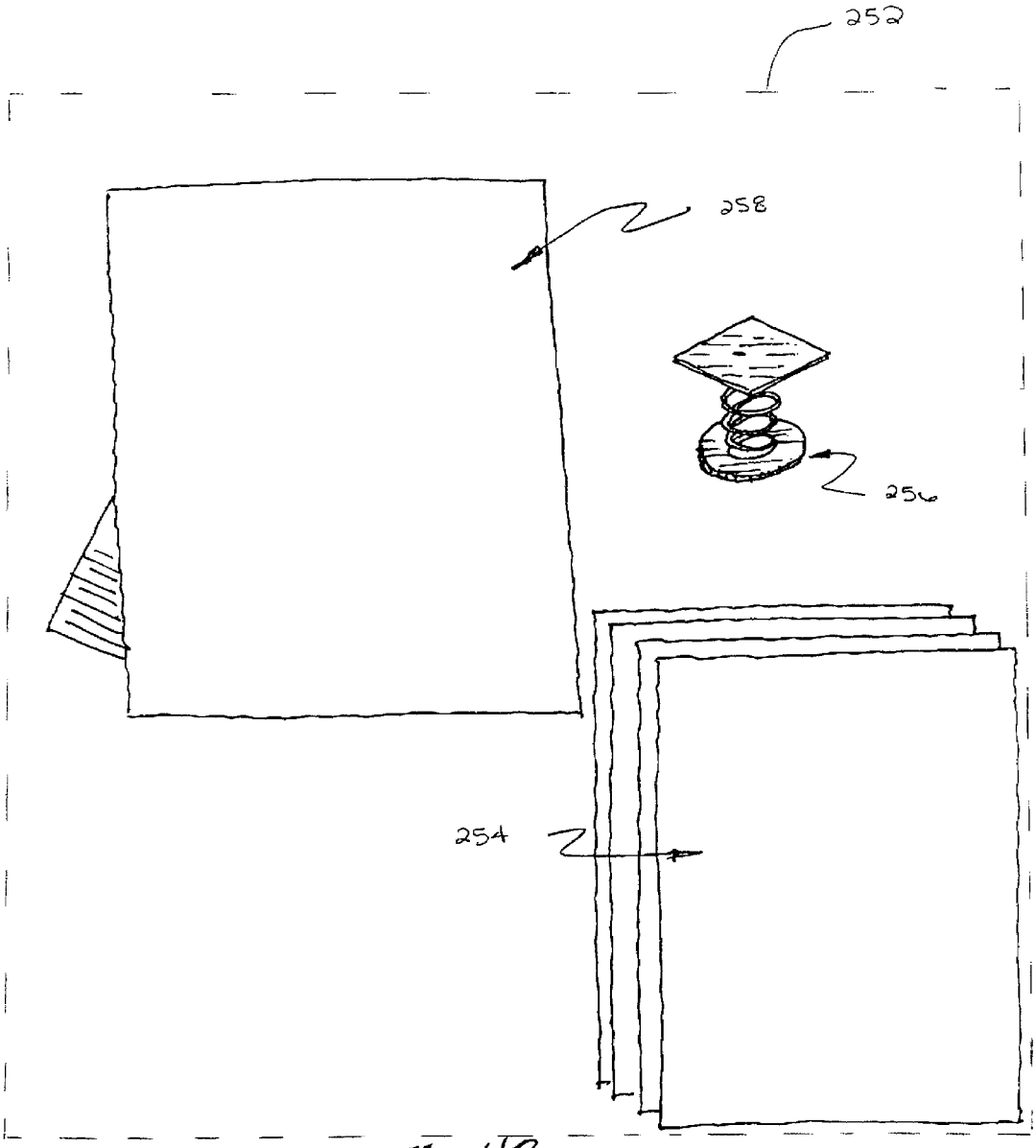
FIG. 48 illustrates another kit for creating wobble objects in accordance with an aspect of the present invention.

FIG. 48 illustrates yet another kit 252 that can be utilized for creating wobble objects. The kit 252 includes photo paper 254 for printing one or more desired images and at least one action wobble mounting assembly 256. The kit 252 also includes at least one easel back photo base 258. The easel back photo base(s) 258 can be preprinted photographs or alternatively, a user can attach any suitable photo to the easel back photo base 258. The mounting assembly(s) 256 is employed to secure a printed image to the easel back photo base 258.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A kit for creating wobble objects comprising:

paper for printing a desired image; and a mounting assembly to secure to a back side of the image, wherein the mounting assembly includes:

at least one first mounting plate;

at least one second mounting plate;

and at least one spring secured to the first mounting plate and the second mounting plate such that the at least one spring extends between the first and second mounting plates in a substantially perpendicular manner;

wherein the first mounting plate and the second mounting plate each includes an adhesive layer provided on a first side of the plate, and wherein each of the first mounting plate and the second mounting plate includes a removable film layer provided over the adhesive layer.

2. The kit of claim 1, further comprising at least one of a body or background for securing the mounting assembly and image thereto.

3. The kit of claim 2, further comprising a base for supporting the body or background.

4. The kit of claim 1, further comprising cardstock to create greeting cards.

5. The kit of claim 1, further comprising one or more magnets.

6. The kit of claim 1, further comprising one or more easel backs.

7. The kit of claim 1, further comprising preprinted images for securing the mounting assembly and image thereto.

8. The kit of claim 1, further comprising at least one book for securing the mounting assembly and image thereto.

9. The kit of claim 1, wherein the spring is a compression spring with substantially flat ends.

10. The kit of claim 1, wherein the spring has a compressed height of 0.099 in. or less.

11. A greeting card comprising:

a base having a recessed area;

a greeting card panel coupled to the base, wherein the greeting card panel is adapted to fold over the base in a book-like manner;

a substantially flat image provided within the recessed area; and a mounting assembly coupled between the base and the image, the mounting assembly comprising:

a first mounting plate;

a spring having a first end portion secured to the first mounting plate such that the spring is substantially perpendicular with respect to the first mounting plate;

wherein the substantially flat image is secured to the first mounting plate, wherein the spring facilitates a wobble movement of the mounting plate and the image in a clockwise and counterclockwise manner with respect to the longitudinal axis of the spring.

12. The greeting card of claim 11, further comprising hook and loop fasteners to hold the greeting card together in a closed manner.

13. The greeting card of claim 12, wherein the greeting card is a self-mailer greeting card and a mailing address can be provided on an outside portion of the greeting card.

14. The greeting card of claim 11, wherein the mounting assembly includes a spring mounted substantially perpendicularly between the base and the substantially flat image.

15. The greeting card of claim 14, wherein the spring has a compressed height of 0.099 in. or less.

16. The greeting card of claim 11, further comprising at least one microchip or battery to provide at least one of a recorded message, music, and voice activation.

17. A mounting assembly for an image comprising:

a first mounting plate,;

a mounting member;

a spring secured between the first mounting plate and the mounting member, wherein of the spring has a first end portion secured to the first mounting plate such that the spring is substantially perpendicular with respect to the first mounting plate, wherein the spring has a second end portion secured to the mounting member such that the spring is substantially perpendicular with respect to the mounting member; and wherein the spring facilitates a wobble movement of the mounting plate in a clockwise and counterclockwise manner with respect to the longitudinal axis of the spring wherein the first mounting plate includes an adhesive layer thereon and a removable film layer provided over the adhesive layer.

18. The mounting assembly of claim 17, wherein the mounting member is a magnet secured to a second end portion of the spring such that the spring is substantially perpendicular with respect to the magnet.

19. The mounting assembly of claim 17, wherein the mounting member is a button shroud secured to a second end portion of the spring.

20. The mounting assembly of claim 17, wherein the mounting member is a snap assembly secured to a second end portion of the spring.

21. The mounting assembly of claim 17, wherein the mounting member is a suction cup assembly secured to a second end portion of the spring.

22. The mounting assembly of claim 17, wherein the mounting member is a hook and loop fastener secured to a second end portion of the spring.

23. The mounting assembly of claim 17, wherein the mounting member is a second mounting plate having an adhesive layer thereon and a removable film layer provided over the adhesive layer.

24. The mounting assembly of claim 17, further comprising a second mounting plate secured to a second end portion of the spring such that the spring is substantially perpendicular with respect to the second mounting plate.

25. The mounting assembly of claim 17, further comprising a spring mount employed to secure the spring to the first mounting plate.

26. The mounting assembly of claim 25, wherein the spring mount comprises epoxy resin.

27. The mounting assembly of claim 17, wherein the spring has a compressed height of 0.099 in. or less.

28. The mounting assembly of claim 17, further comprising a microchip to provide at least one of audio or visual output secured to a second end portion of the spring.

* * * * *